US005358351A

United States Patent [19]

Murata et al.

[11] Patent Number: 5,358,351

[45] Date of Patent: Oct. 25, 1994

[54] PRINTING APPARATUS AND PRINTING TAPE CASSETTE USED THEREFOR

[75] Inventors: Yoshiyuki Murata, Oome; Kenji Kobayashi, Akigawa, both of Japan

[73] Assignee: Casio Computer Co., Ltd., Tokyo, Japan

[21] Appl. No.: 64,277

[22] Filed: May 20, 1993

[30] Foreign Application Priority Data

Sep. 30, 1992 [JP] Japan ..... 4-286926
Dec. 15, 1992 [JP] Japan ..... 4-334366

[51] Int. Cl.[5] ..... B41J 3/02; B41J 11/48

[52] U.S. Cl. ..... 400/605; 400/586; 400/591; 400/593; 400/582; 400/583; 400/619; 400/621; 400/208; 400/613

[58] Field of Search ..... 400/120, 586, 587, 590, 400/591, 593, 594, 594.1, 196, 208, 208.1, 621, 605, 608, 608.1, 608.3, 608.4, 323, 126, 582, 583, 619

[56] References Cited

U.S. PATENT DOCUMENTS 3,912,064 10/1975 Bluem et al. .
4,253,774 3/1981 Hanakata et al. .
4,293,236 10/1981 Shimizu ..... 400/593
4,391,539 7/1983 Connoy .
4,419,175 12/1983 Bradshaw et al. .
4,579,466 4/1986 Sato et al. ..... 400/208
4,917,514 4/1990 Richardson ..... 400/208
4,982,202 1/1991 Buan et al. ..... 400/120
5,168,814 12/1992 Kuzuya et al. .
5,183,333 2/1993 Minowa ..... 400/605
5,193,919 3/1993 Godo et al. ..... 400/208
5,224,786 7/1993 Takagl et al. ..... 400/621
5,232,297 8/1993 Kitazawa ..... 400/621

FOREIGN PATENT DOCUMENTS 0145487 8/1983 Japan ..... 400/586
62-109958 7/1987 Japan .
4-34048 8/1987 Japan .
4-34047 8/1992 Japan .

*Primary Examiner*—Eugene H. Eickholt
*Attorney, Agent, or Firm*—Frishauf, Holtz, Goodman & Woodward

[57] ABSTRACT

A printing apparatus includes a main body in which a sheet-like printing medium or a tape-like printing medium contained in a cassette can be mounted, a printing head capable of printing an image either on the sheet-like printing medium or the tape-like printing medium, and a control unit for, when an image is printed on the sheet-like printing medium, controlling the printing head and the sheet-like printing medium to make them move relative to each other and cause the printing head to print the image on the sheet-like printing medium, and for, when an image is printed on the tape-like printing medium, controlling the printing head and the tape-like printing medium to make them move relative to each other and cause the printing head to print the image on the tape-like printing medium. A printing tape cassette suitable for the printing apparatus includes a main body for containing a tape-like printing medium on which an image is printed by the printing head, and a bending structure for bending a printed portion of the printing medium after an image is printed thereon by the printing head.

16 Claims, 18 Drawing Sheets

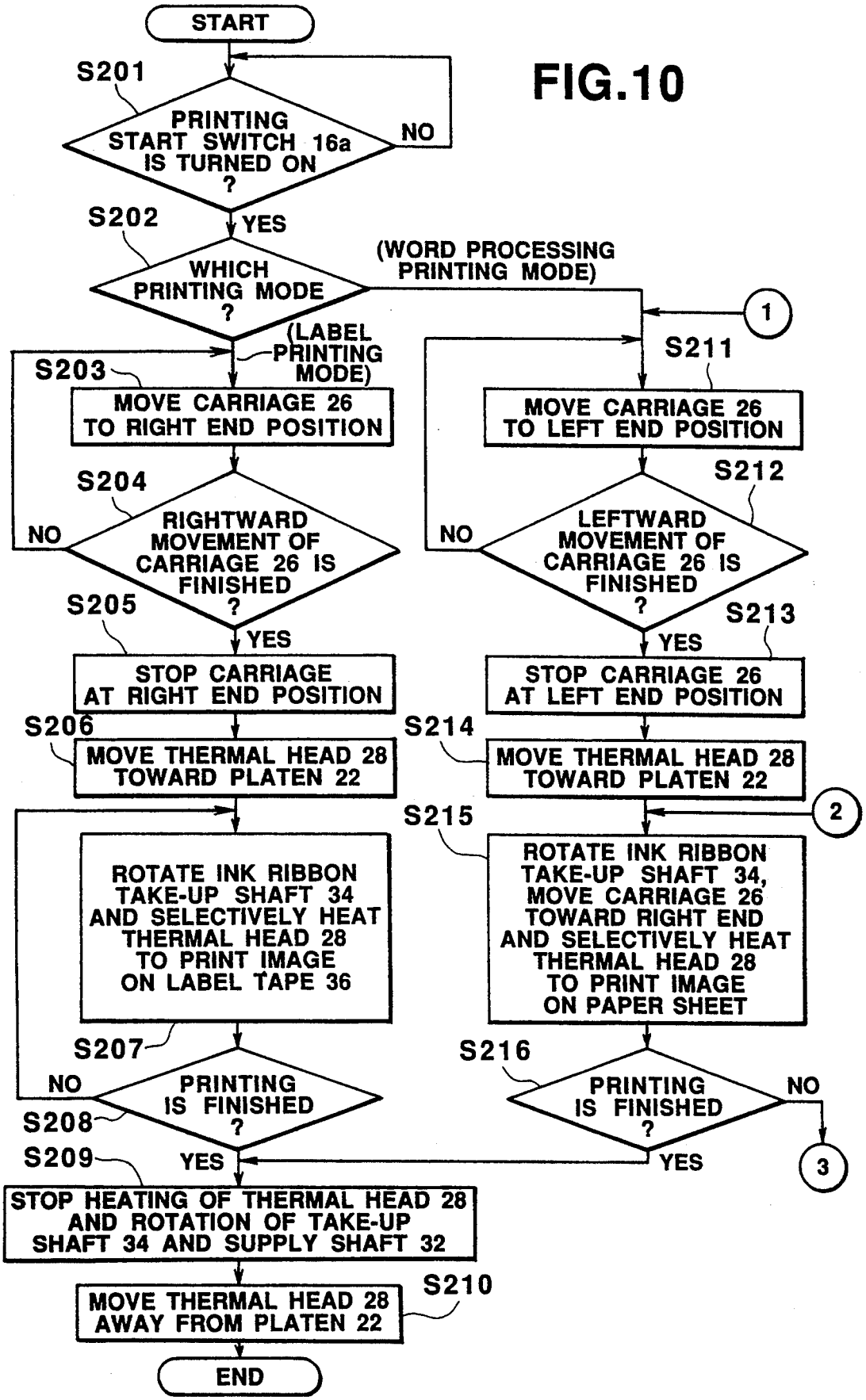
FIG.10
START
S201
PRINTING START SWITCH 16a IS TURNED ON ?
NO
YES
S202
WHICH PRINTING MODE ?
(WORD PROCESSING PRINTING MODE)
(LABEL PRINTING MODE)
1
S203
MOVE CARRIAGE 26 TO RIGHT END POSITION
S211
MOVE CARRIAGE 26 TO LEFT END POSITION
S204
RIGHTWARD MOVEMENT OF CARRIAGE 26 IS FINISHED ?
NO
S212
LEFTWARD MOVEMENT OF CARRIAGE 26 IS FINISHED ?
NO
S205
YES
STOP CARRIAGE AT RIGHT END POSITION
S213
YES
STOP CARRIAGE 26 AT LEFT END POSITION
S206
MOVE THERMAL HEAD 28 TOWARD PLATEN 22
S214
MOVE THERMAL HEAD 28 TOWARD PLATEN 22
2
S215
ROTATE INK RIBBON TAKE-UP SHAFT 34 AND SELECTIVELY HEAT THERMAL HEAD 28 TO PRINT IMAGE ON LABEL TAPE 36
ROTATE INK RIBBON TAKE-UP SHAFT 34, MOVE CARRIAGE 26 TOWARD RIGHT END AND SELECTIVELY HEAT THERMAL HEAD 28 TO PRINT IMAGE ON PAPER SHEET
S207
S216
NO
PRINTING IS FINISHED ?
S208
PRINTING IS FINISHED ?
NO
S209
YES
YES
3
STOP HEATING OF THERMAL HEAD 28 AND ROTATION OF TAKE-UP SHAFT 34 AND SUPPLY SHAFT 32
S210
MOVE THERMAL HEAD 28 AWAY FROM PLATEN 22
END

PRINTING APPARATUS AND PRINTING TAPE CASSETTE USED THEREFOR

BACKGROUND OF THE INVENTION

1. Field of the Invention

The present invention relates to a printing apparatus and, more particularly, to a printing apparatus which can selectively print images such as characters, numerals, and graphic patterns on a sheet-like printing medium, e.g., plain paper, and on a tape-like printing medium, e.g., a label tape, so as to be used not only as a printer for a wordprocessor but also as a label printer, and relates to a printing tape cassette suitable for the printing apparatus.

2. Description of the Related Art

Printing apparatuses of various printing types such as the ink jet type, the wire dot type, and the thermal transfer type have been put into practice. Some of these printing apparatuses are connected to wordprocessors to print images on plain papers (such apparatuses will be referred to as general printers for the sake of descriptive convenience), and others are used as label printers for printing images on label tapes.

However, each of the above-described two types of printers can only perform a printing operation on the above described corresponding type of printing medium. For example, the general printer can print images on a plain paper, but cannot print images on a tape-like printing medium such as a label tape (to be referred as a label tape for the sake of descriptive convenience). In contrast to this, the label printer can print images on the label tape, but cannot print images on the sheet-like printing medium such as a plain paper (to be referred as plain paper for the sake of descriptive convenience). For this reason, a user who wants to print images on both a plain paper and a label tape must purchase or prepare both the general printer and the label printer, resulting in an increase in the economical load of the user.

Some conventional label printers are constituted as serial printers. Such a printer uses a printing tape cassette containing both a label tape and a printing tape in the same housing. In this printer, a printed label tape is discharged from the housing in a direction opposite to the moving direction of the tape cassette. If printing is performed in large quantities and a long printed label tape is discharged from the housing, the discharged label tape hang down into an inner space of the printer housing. In this case, when the hanging down printed label tape is taken out from the inner space of the printer housing, the label tape may be smeared or caught by a member in the printer housing to be damaged.

The present invention has been derived from the above situation, and its object is to provide a printing apparatus which can print images not only on a sheet-like printing medium such as a plain paper but also on a tape-like printing medium such as a label tape, and a printing tape cassette which is used in the printing apparatus and can effectively prevent a printed label tape from being smeared or damaged.

SUMMARY OF THE INVENTION

In order to achieve the above object, a printing apparatus according to the present invention comprises: an apparatus main body in which a sheet-like printing medium or a tape-like printing medium contained in a cassette can be mounted; printing means capable of printing an image either on the sheet-like printing medium or the tape-like printing medium contained in the cassette; and control means for, when an image is printed on the sheet-like printing medium, controlling the printing means and the sheet-like printing medium to make them move relative to each other and cause the printing means to print the image on the sheet-like printing medium, and for, when an image is printed on the tape-like printing medium, controlling the printing means and the tape-like printing medium to make them move relative to each other and cause the printing means to print the image on the tape-like printing medium.

In the printing apparatus having the above-described arrangement according to the present invention, the control means can be constructed by including mode setting means capable of selectively setting first and second printing modes, first control means for, when the first printing mode is set by the mode setting means, controlling the printing means to perform printing an image on the sheet-like printing medium, and second control means for, when the second printing mode is set by the mode setting means, controlling the printing means to perform printing an image on the tape-like printing medium.

In this case, the mode setting means may be an operating member for allowing mode setting by a manual 10 operation, or may be means for automatically setting the second printing mode when the cassette is mounted in the apparatus main body.

If the printing means is designed to be movable relative to the apparatus main body, the control means allows the relative movement in forward and reverse directions, for each printing operation, when an image is printed on the sheet-like printing medium, and allows the relative movement in only one direction, for each printing operation, when an image is printed on the tape-like printing medium.

By further containing an ink ribbon in the cassette, a printing head for printing an image on the printing medium through the ink ribbon may be used as the printing means.

The printing means may be a printing head for printing an image on the printing medium by ejecting liquid ink thereon.

A printing tape cassette, used in the printing apparatus of the present invention to achieve the above object, comprises: a cassette main body for containing a tape-like printing medium on which an image is printed by printing means; and bending means for bending a printed portion of the printing medium after an image is printed thereon by the printing means.

It is especially preferable that the bending means is constituted by guide means for bending the printed 10 portion of the printing medium toward an upper surface of the cassette main body.

In addition, it preferable that the cassette further comprises indicating means, arranged near the bending means, for indicating a position at which the printed portion of the printing medium should be cut, in order to quickly collect the printed portion of the printing medium without smearing or damaging it.

The printing tape cassette of the present invention may be a cassette detachably mounted in a carriage of a printing apparatus for printing an image on a sheet-like printing medium placed thereon while moving the carriage having printing means along the sheet-like printing medium in a predetermined direction. In this case, the cassette can contain a tape-like printing medium, on which an image is printed by the printing means, instead of the sheet-like printing medium.

By further containing an ink ribbon in the cassette, a printing head for printing an image on the printing medium through the ink ribbon may be used as the printing means. In addition, if the ink ribbon is constituted by a heat sensitive ink ribbon formed by impregnating a base member with a hot-melt or hot-sublimation ink, the printing head may be constituted by a thermal head having a large number of heating elements.

It is preferable that the cassette further comprise bending means for bending the printed tape portion after an image is printed thereon by the printing means, and it is especially preferable that the bending means is constituted by guide means for bending the printed portion of the printing medium toward the upper surface of the cassette main body.

In addition, it is preferable that the cassette further comprises indicating means, arranged near the bending means, for indicating a position at which the printed portion of the printing medium should be cut, in order to quickly collect the printed portion of the printing medium without smearing or damaging it.

As the printing means, a printing head for printing an image on the printing medium by ejecting liquid ink thereon may be used.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 10 is a flow chart showing a main part of an action of the printing apparatus in FIG. 8;

DETAILED DESCRIPTION OF THE PREFERRED EMBODIMENTS

Various embodiments of the present invention will be described below with reference to the accompanying drawings.

Figure 1:
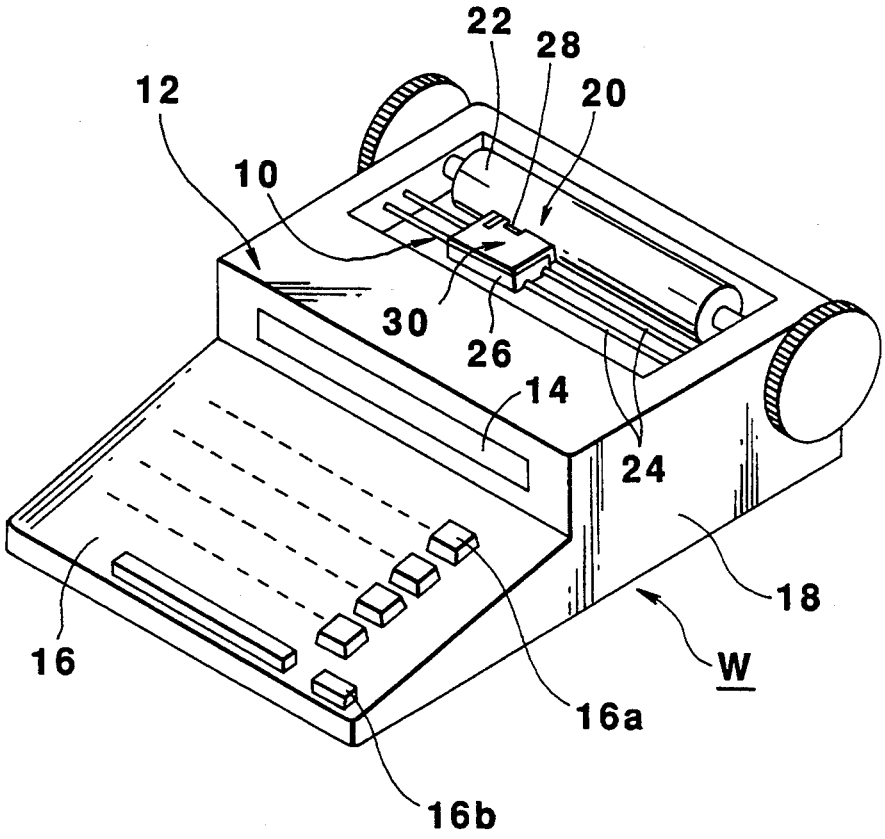
FIG. 1 is a perspective view schematically showing a wordprocessor incorporating a printing apparatus according to a first embodiment of the present invention.
Figure 2:
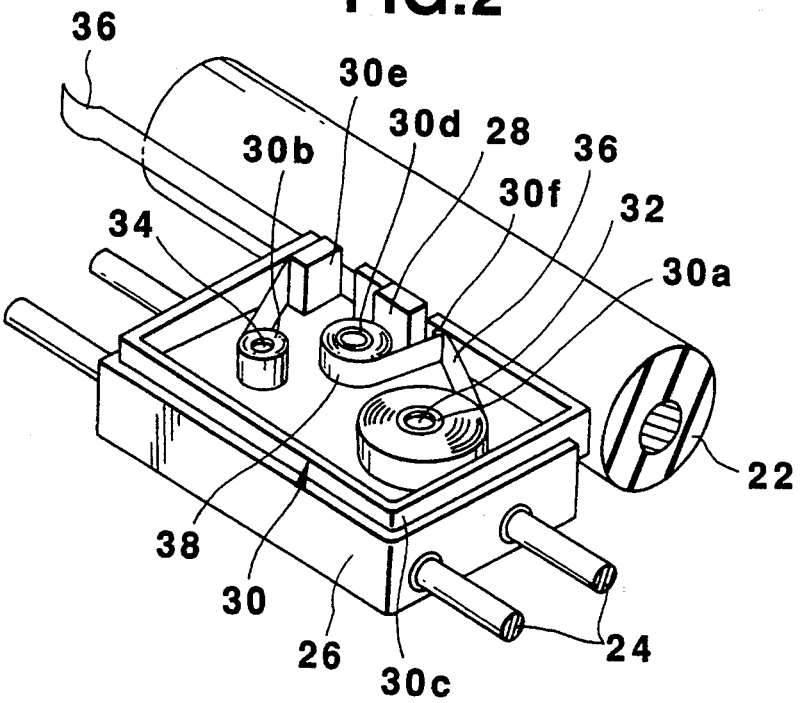
FIG. 2 is an enlarged perspective view showing a main part of the printing apparatus while a label tape printing mode is set in the printing apparatus.
Figure 3:
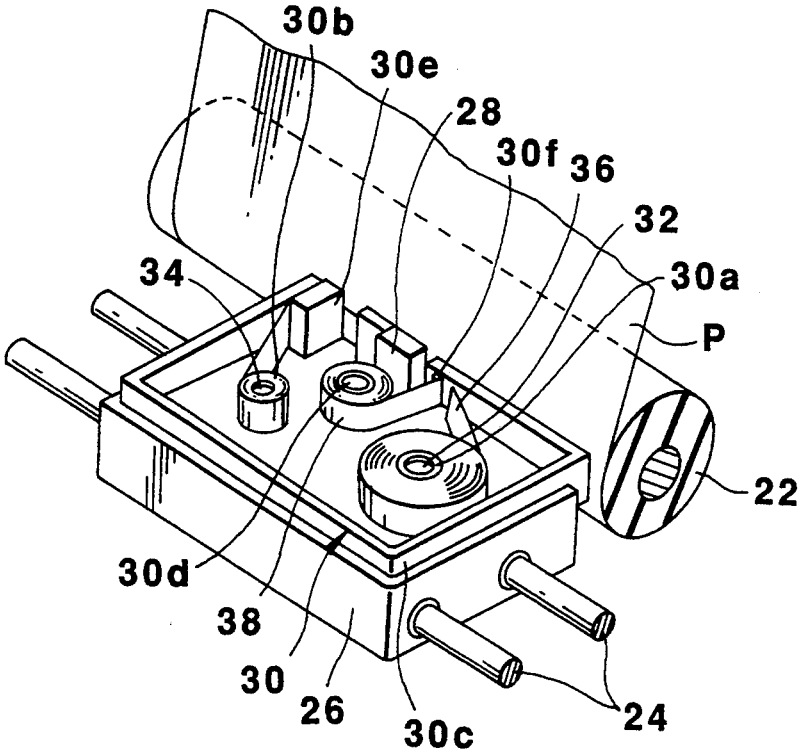
FIG. 3 is an enlarged perspective view showing a main part of the printing apparatus while a wordprocessing printing mode is set in the printing apparatus.
Figure 4:
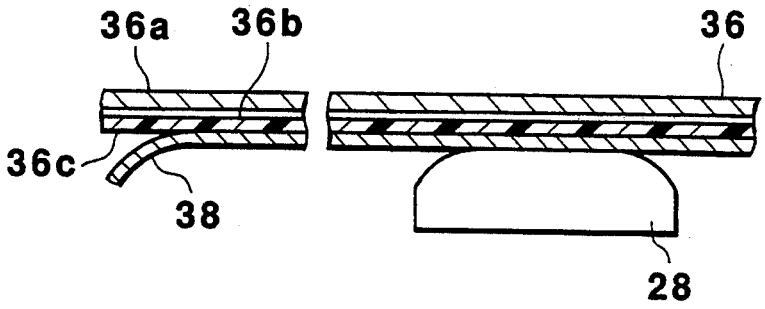
FIG. 4 is an enlarged sectional view showing an overlapped state of a label tape and an ink ribbon, drawn out from a printing tape cassette in the main part of FIG. 2, on a thermal head.
Figure 5:
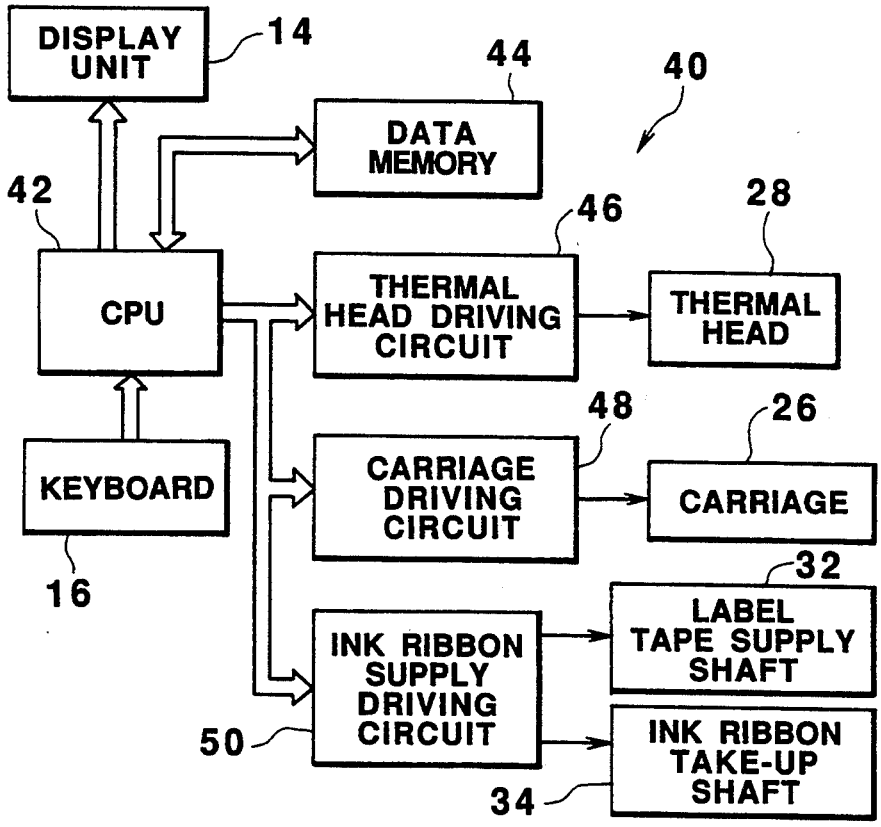
FIG. 5 is a block diagram of control means of the printing apparatus in FIG. 2.
Figure 6:
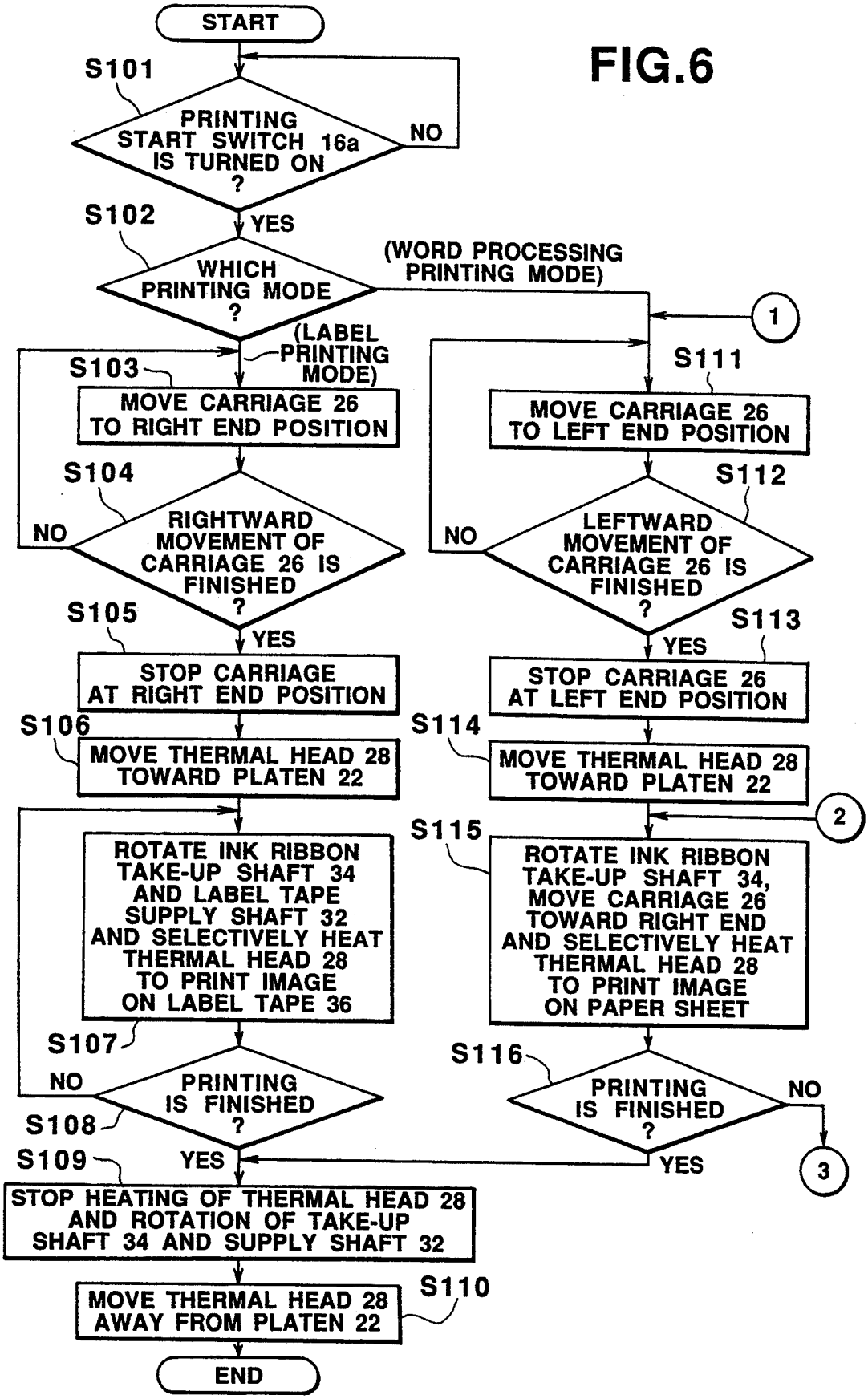
FIG. 6 is a flow chart showing a main part of an action of the printing apparatus in FIG. 2.
Figure 7:
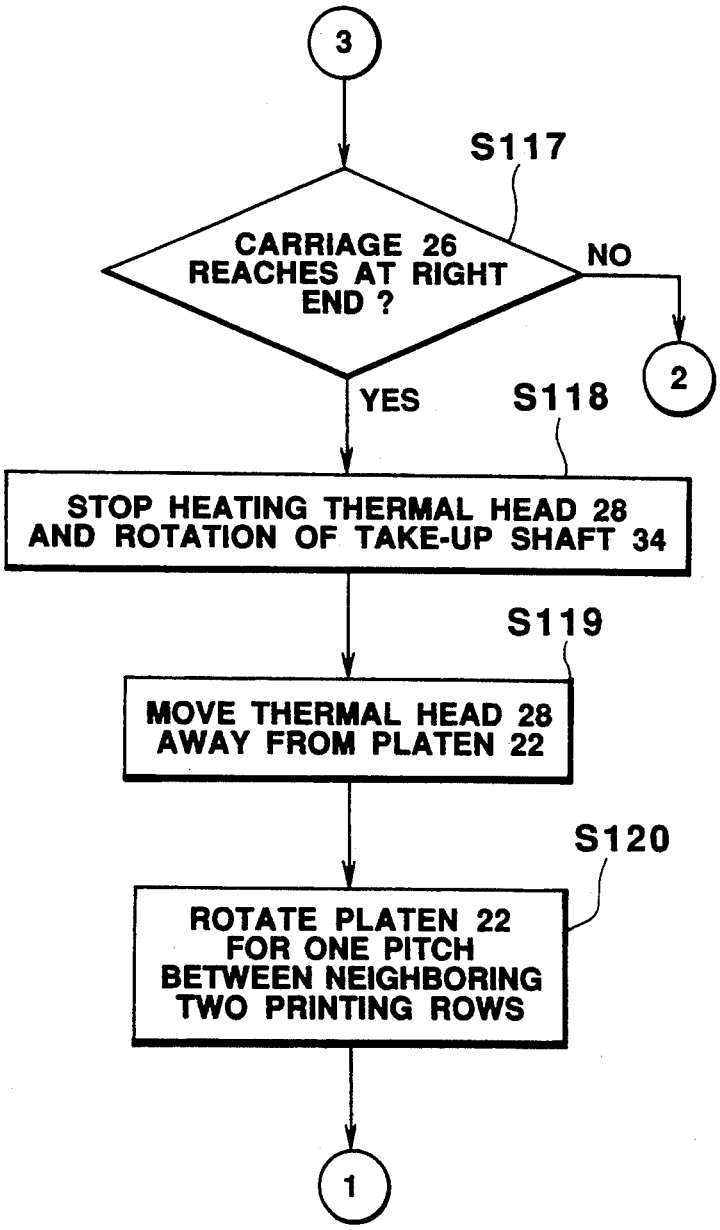
FIG. 7 is a flow chart showing a remaining part of the action of the printing apparatus in FIG. 2.

FIGS. 1 to 7 show a printing apparatus according to a first embodiment of the present invention. FIG. 1 is a perspective view of a wordprocessor incorporating the printing apparatus. FIG. 2 is an enlarged perspective view of a main part of the printing apparatus in FIG. 1 in a label tape printing mode. FIG. 3 is an enlarged perspective view of a main part of the printing apparatus in FIG. 1 in a wordprocessing printing mode. FIG. 4 is an enlarged sectional view showing a stacked state of a label tape and an ink ribbon drawn out from a printing tape cassette in the main part of FIG. 2. FIG. 5 is a block diagram of control means of the printing apparatus. FIGS. 6 and 7 are flow charts showing an action of the printing apparatus.

Referring to FIG. 1, a wordprocessor W is constituted by a serial printing apparatus 10 of a thermal transfer type and a main body 12 of the wordprocessor W. The main body 12 includes a display unit 14, a keyboard 16, and a control means housing portion 18. The keyboard 16 has a printing start switch 16*a* and a mode switch (mode selecting means) 16*b*. The wordprocessor W displays image information formed through the keyboard 16, e.g., a document, or image information stored in a memory in control means on the display unit 14. The wordprocessor W also stores image information in the memory. When the printing start switch 16*a* is operated, the printing apparatus 10 prints image information, displayed on the display unit 14, on a label tape or recording paper sheet in accordance with a label tape printing mode or a wordprocessing printing mode selected by operating the mode switch 16*b*.

The keyboard 16 has various known character and function keys in addition to the above-mentioned two switches 16*a* and 16*b*. A description of these known keys will be omitted.

The control means housing portion 18 has an opening in its upper surface. In this opening, a printing mechanism 20 of the serial printing apparatus 10 is arranged, together with various mechanisms including a feeding mechanism for a recording paper sheet used in the printing apparatus 10. The feeding mechanism feeds the recording paper sheet, inserted from a rear side of a platen roller 22, along a lower half portion of a surface of the platen roller 22 toward the printing mechanism 20 located on the front side of the platen roller 22. The feeding mechanism feeds the recording paper sheet upward from the front side of the platen roller 22 every time printing of one line is completed by the printing mechanism 20.

The printing mechanism 20 includes two guide rods 24 extending parallel to and along the platen roller 22, and a carriage 26 supported by the guide rods 24 so as to be able to reciprocate in the longitudinal direction of the guide rods 24. The carriage 26 is provided with a thermal head 28 and a printing tape cassette 30.

On the carriage 26, the thermal head 28 is freely movable toward/away from the platen roller 22. The printing tape cassette 30 is detachably mounted to an ink ribbon driving mechanism (not shown) in the carriage 26. The thermal head 28 is moved toward or away from the platen roller 22 while the carriage 26 is moved on the guide rods 24 in accordance with a printing signal from printing control means in the control means housing portion 18. Upon moving toward the platen roller 22, the thermal head 28 selectively causes a large number of heating elements to generate heat. The heating elements which have generated heat transfer an ink on a thermal transfer ink ribbon in the cassette 30, the ink ribbon being travelled upon movement of the carriage 26, to the recording paper sheet on the platen roller 22, thus forming an image based on the printing signal (i.e., performing a printing operation).

when the wordprocessing printing mode is selected by using the mode switch 16*b* of the keyboard 16, the movement of the carriage 26 is controlled by the control means in the control means housing portion 18 to move forward and backward on the guide rods 24 in accordance with a printing signal. When the label tape printing mode is selected, the carriage 26 is moved from a predetermined initial position to left ends of the guide rods 24, and is subsequently moved from the left ends to right ends of the guide rods 24 only at one time.

In a cassette mounting portion, in which the printing tape cassette 30 is detachably mounted, on the upper surface of the carriage 26, a label tape supply shaft 32 and an ink ribbon take-up shaft 34, both coupled to driving means in the carriage 26, are projected upward at positions separated from each other by a predetermined distance in the longitudinal direction of the platen roller 22, as shown in FIG. 2. The label tape supply shaft 32 and the ink ribbon take-up shaft 34 are respectively fitted in a label tape supply reel hub 30*a* and an ink ribbon take-up reel hub 30*b* of the cassette 30 and are driven by the above-mentioned driving mechanism to rotate the reel hubs 30*a* and 30*b* counterclockwise.

The cassette 30 has a substantially rectangular shape. In FIG. 2, an upper half case of the cassette 30 is removed to show contents of an internal space of the cassette 30. That is, FIG. 2 shows only a lower half case 30*c* of the cassette 30. A thermal head insertion window is formed in a longitudinally extending wall of the cassette 30, which opposes the platen roller 22. When the cassette 30 is mounted in the cassette mounting portion, the thermal head 28 is arranged in the insertion window. In the cassette 30, in addition to the label tape supply reel hub 30*a* and the ink ribbon take-up reel hub 30*b*, an ink ribbon supply reel hub 30*d*, a ribbon guide member 30*e*, a tape guide roller 30*f*, etc. are arranged between the hubs 30*a* and 30*b*.

A label tape 36 is wound around the label tape supply reel hub 30*a*. A thermal transfer ink ribbon 38 is wound around the ink ribbon supply reel hub 30*d*. The ink ribbon 38 drawn out from the ink ribbon supply reel hub 30*d* is exposed in the thermal head insertion window between the tape guide roller 30*f* and the ribbon guide member 30*e*, and is wound around the ink ribbon take-up reel hub 30*b*. The thermal transfer ink ribbon 38 contacts a heating element side surface of the thermal head 28, opposing the platen roller 22, in the thermal head insertion window.

In the cassette 30, when the wordprocessor W in FIG. 1 is used in the label tape printing mode, the label tape 36 is drawn out into the thermal head insertion window and is overlapped on an outer side surface of the thermal transfer ink ribbon 38, as shown in FIG. 2. Thereafter, the label tape 36 is further drawn out in the longitudinal direction of the platen roller 22 therealong. When the wordprocessor W is used in the wordprocessing printing mode, the label tape 36 is not drawn out into the thermal head insertion window, as shown in FIG. 3. Note that a temporary holding means for the label tape 36 can be arranged at a drawn out opening for the label tape 36 in the insertion window of the cassette 30, and a leading end of the label tape 36 can be temporarily held by the temporary holding means in the wordprocessing printing mode. FIG. 3 also shows a recording paper sheet P set along a lower half portion of the platen roller 22 and opposing the thermal head 28 in the wordprocessing printing mode.

As shown in FIG. 4, the label tape 36 is designed such that a tape-shaped label 36*c* is stacked on a tape-shaped backing paper 36*a* through an adhesive layer 36*b* so as to be peeled off. The ink ribbon 38 is formed by impregnating a base member with a hot-melt or hot-sublimation ink. The label tape 36 and the ink ribbon 38 are overlapped each other on the thermal head 28 in a state that the ink ribbon 38 contacts the heating element side surface of the thermal head 28 and the label 36*c* of the label tape 36 contacts the ink ribbon 38.

FIG. 5 schematically shows control means 40 in the control means housing portion 18 of the wordprocessor W in FIG. 1. The control means 40 includes a CPU (central processing unit) 42, a data memory 44, a thermal head driving circuit 46, a carriage driving circuit 48, an ink ribbon supply driving circuit 50, etc. The keyboard 16 and the display unit 14 are connected to the CPU 42. Display control for the display unit 14 and control for the driving circuits 46, 48, and 50 are performed on the basis of key inputs through the keyboard 16.

The thermal head driving circuit 46 moves the thermal head 28 toward or away from the platen roller 22 in accordance with a printing signal from the CPU 42, and causes selected heating elements to generate heat when the thermal head 28 is moved toward the platen roller 22. Meanwhile, the carriage driving circuit 48 moves the carriage 26 along the platen roller 22, and the ink ribbon supply driving circuit 50 controls the rotation of the label tape supply shaft 32 and the ink ribbon take-up shaft 34 of the carriage 26. In this embodiment, the ink ribbon supply driving circuit 50 rotates only the ink ribbon take-up shaft 34 when the wordprocessor W is set in the wordprocessing printing mode, and rotates both the label tape supply shaft 32 and the ink ribbon take-up shaft 34 when the wordprocessor W is set in the label tape printing mode. Note that a one-way clutch is incorporated in the label tape supply shaft 32 to allow the label tape supply reel hub 30*a* to freely rotate counterclockwise while the rotation of the shaft 32 is stopped. That is, while the rotation of the label tape supply shaft 32 is stopped, the label tape 36 can be manually drawn out from the label tape supply reel hub 30*a*.

Now, an action of the embodiment will be described.

In the embodiment, the processes shown in the flow charts in FIGS. 6 and 7 are performed by the CPU 42.

As shown in FIG. 6, it is checked in a step S101 whether the printing start switch 16*a* of the keyboard 16 of the wordprocessor W in FIG. 1 is turned on or not. If it is turned on, a kind of printing mode is checked in a step S102. If a label tape printing mode is set, processes from a step S103 to a step S110 are performed. If a wordprocessing printing mode is set, processes from a step S111 to a step S116 and the steps S109 and S110 or from the step S111 to a step S120 are performed.

When the processes for the label tape printing mode are to be performed, the label tape 36 is drawn out from the cassette 30 into the thermal head insertion window and is overlapped on the ink ribbon 38 on the thermal head 28, as shown in FIG. 2. When the processes for the wordprocessing printing mode are to be performed, the label tape 36 is not drawn out from the cassette 30, as shown in FIG. 3, and the recording paper sheet p is set at a predetermined position on the platen roller 22.

when it is determined in the step S102 that the label tape printing mode is set, the carriage 26 is temporarily moved to a right end position on the guide bars 24, at which the carriage 26 opposites the platen roller 22, in a step S103. If it is determined in a step S104 that the above-mentioned rightward movement of the carriage 26 is finished, the movement of the carriage 26 is stopped in a step S105. In a step S106, the thermal head 28 is moved toward the platen roller 22, and the ink ribbon 38 and the label tape 36 are lightly pushed on an outer peripheral surface of the platen roller 22 in the overlapped state by the heating element side surface of the thermal head 28.

In a step S107, both the label tape supply shaft 32 and the ink ribbon take-up shaft 34 are simultaneously rotated at a predetermined rotational speed, and a large number of heating elements of the thermal head 28 are sequentially and selectively caused to generate heat in accordance with a printing signal. Consequently, as shown in FIG. 2, while the ink ribbon 38 drawn out from the ink ribbon supply reel hub 30*d* is taken up by the ink ribbon take-up reel hub 30*b*, the label tape 36 is horizontally fed to the left of the cassette 30 along the platen roller 22, and an image or images based on the printing signal is thermally transferred from the ink ribbon 38 onto the tape-shaped label 36*c* of the label tape 36 by the thermal head 28.

In a step S108, it is checked whether printing of the image or images based on all printing signals is finished or not. If it is not finished, the step S107 is repeated. If it is finished, the heating of the thermal head 28 and the rotation of the label tape supply shaft 32 and the ink ribbon take-up shaft 34 are stopped in a step S109. In a step S110, the thermal head 28 is moved away from the platen roller 22, and the processes for the label tape printing mode are completed.

A portion of the label tape 36, which is discharged from the cassette 30 and on which an image or images is printed, is cut from a remaining portion of the label tape 36, on which a image or images has not been printed, by cutting means such as a knife, scissors or the like. The label 36*c*, together with the adhesive layer 36*b*, of the printed and cut out portion of the label tape 36 is separated from the backing paper 36*a* (FIG. 4) so that the printed portion of the label 36*c* can be adhered on a desired place with the adhesive layer 36*b*. According to the embodiment, in the label tape printing mode, images can only be continuously printed on the label tape 36 by a one-line length maximumly corresponding to the longitudinally length of the platen roller 22. Otherwise, a long printed portion of the label tape 36 hangs down from the cassette 30 into the opening of the upper surface of the control means housing portion 18 of the main body 12 of the wordprocessor W in FIG. 1, and the printed portion may be twisted around members in the opening to be smeared or be damaged when it is picked up from the opening.

If it is determined in the step S102 that the wordprocessing printing mode is set, the carriage 26 is temporarily moved to a left end position on the guide bars 24 with respect to the platen roller 22 in a step S111. If it is determined in a step S112 that the carriage 26 is moved to the left end position, the movement of the carriage 26 is temporarily stopped in a step S113. In a step S114, the thermal head 28 is moved toward the platen roller 22, and the ink ribbon 38 is lightly pushed on the recording paper sheet P on the platen roller 22 by the heating elements side surface of the thermal head 28.

In a step S115, the ink ribbon take-up shaft 34 is rotated at a predetermined speed and the carriage 26 is moved toward a right end on the guide bars at a predetermined speed. At the same time, a large number of heating elements of the thermal head 28 are sequentially and selectively caused to generate heat in accordance with a printing signal. With this action, an image or images based on the printing signal is thermally transferred from the ink ribbon 38 onto the recording paper sheet P. In a step S116, it is checked whether printing of the image or images based on all printing signals is finished or not. If it is finished, the above-described processes in the steps S109 and S110 are performed and the wordprocessing printing mode is completed. If it is not finished, process in a step S117 is performed.

In the step S117, it is checked whether the carriage 26 has reached at the right end position on the guide bars 24. If it is not reached, the processes in the steps S115 and S116 are performed again. If it is reached at the right end position, the heating action of the thermal head 28 and the rotation of the ink ribbon take-up shaft 34 are stopped in a step S118. In a step S119, the thermal head 28 is moved away from the platen roller 22. In a step S120, the platen roller 22 is rotated by an amount corresponding to a predetermined line space. Thereafter, the processes from the step S111 to the step S116 are performed again to perform printing an image or images on a next line on the recording paper sheet P in accordance with the remaining printing signals.

As described above, in the first embodiment, the label tape printing mode is set by operating the mode switch **16*b* of the keyboard 16, and the label tape 36 is drawn out from the cassette 30 and is overlapped on the ink ribbon 38 on the thermal head 28, as shown in FIG. 2, thus printing an image or images on the label tape 36. When the wordprocessing printing mode is set by operating the mode switch 16*b*, the label tape 36 is not drawn out from the cassette 30 as shown in FIG. 3, and only the ink ribbon 38 is passed on the thermal head 28, thus printing an image or images on the recording paper sheet P on the platen roller 22. Therefore, by purchasing only one wordprocessor W provided with the printing apparatus 10 according to the first embodiment of the present invention, a user who intends to print an image or images on both the label tape 36** and the recording paper sheet p can perform two kinds of printing modes, thereby reducing the economical load of the user.

FIGS. 8 to 12 respectively show a main part of a printing apparatus according to a second embodiment of the present invention, three types of printing tape cassettes used therein, and flow charts of an action of the second embodiment.

The same parts in the second embodiment as those in the first embodiment are denoted by the same reference numerals, and a description thereof will be omitted.

In the second embodiment, a label tape printing cassette 30A and a wordprocessing printing cassette 30B are independently prepared, and a detection switch for discriminating the two types of cassettes, i.e., the cassettes 30A and 30B, is arranged in a cassette mounting portion of a carriage 26. The label tape printing mode and the wordprocessing printing mode are automatically switched on the basis of a signal from the detection switch.

In either of the printing modes, no rotational force is transmitted to a label tape supply shaft 32, and the shaft 32 is always freely rotatable.

Figure 8:
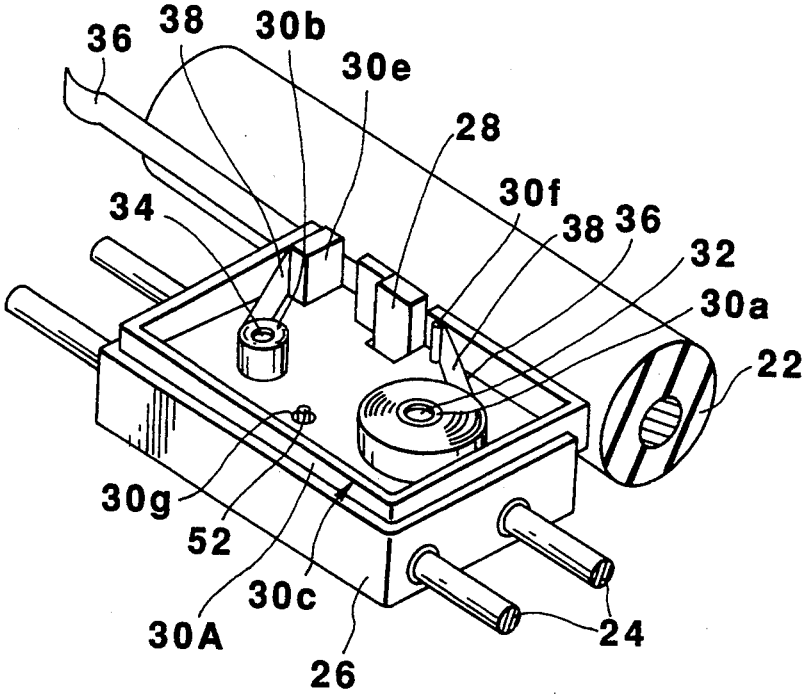
FIG. 8 is a perspective view showing a main part of a printing apparatus according to a second embodiment of the present invention, in a state that a label tape printing cassette is mounted and a label tape printing mode is set.

As shown in FIG. 8, the label tape printing cassette 30A does not have the ink ribbon supply reel hub **30*d*, provided in the printing tape cassettes 30 used in the printing apparatus of the first embodiment as shown in FIGS. 2 and 3, between a label tape supply reel hub 30*a* and an ink ribbon take-up reel hub 30*b*. An ink ribbon 38 and a label tape 36 are overlapped on each other and wound around the label tape supply reel hub 30*a*. The ink ribbon 38 and the label tape 36 are drawn out together from the label tape supply reel hub 30*a* into a thermal head insertion window of the cassette 30A and are passed over the heating element surface of a thermal head 28 in an overlapped state, similar to the first embodiment shown in FIG. 4. Thereafter, the ink ribbon 38 and the label tape 36 are separated from each other at a ribbon guide member 30*e* such that the ink ribbon 38 advances toward the ink ribbon take-up reel hub 30*b* and the label tape 36 extends along a platen roller 22 in its longitudinal direction. An opening 30*g* is formed in a bottom surface of a lower half case 30*c* of the label tape printing cassette 30A. A detection projection 52 of the printing cassette type discriminating detection switch protrudes from the cassette mounting portion of the carriage 26, and is inserted in the opening 30*g*. In this case, the detection projection 52 is not depressed by the lower half case 30*c* so that the CPU 42 shown in FIG. 5 recognizes that the label tape printing cassette 30A is mounted in the cassette mounting portion. With this recognition, the CPU 42** sets the label tape printing mode in the printing apparatus of the second embodiment.

Figure 9:
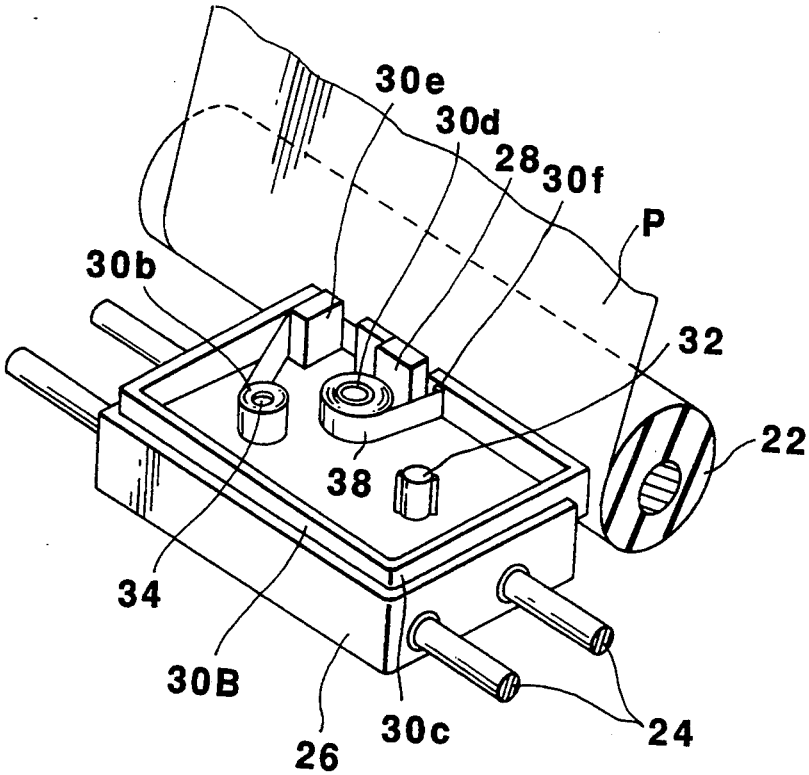
FIG. 9 is a perspective view showing a state in which a wordprocessing printing cassette is mounted in the main part in FIG. 8, and the wordprocessing printing mode is set.

As shown in FIG. 9, the wordprocessing printing cassette 30B does not have the label tape supply reel hub **30*a* shown in FIG. 8, but has the ink ribbon supply reel hub 30*d* provided in the printing tape cassette 30 used in the printing apparatus of the first embodiment as shown in FIGS. 2 and 3. The ink ribbon 38 drawn out from the ink ribbon supply reel hub 30*d* into a thermal head insertion window of the wordprocessing printing cassette 30B passes on the heating element surface of the thermal head 28, and is guided to an ink ribbon take-up reel hub 30*b* by a ribbon guide member 30*e*. The wordprocessing printing cassette 30B has no opening for allowing insertion of the detection projection 52 (FIG. 8) of the printing cassette type discriminating detection switch in a bottom surface of a lower half case 30*c*. In this case, the detection projection 52 is depressed by the lower half case 30*c* so that the CPU 42 shown in FIG. 5 recognizes that the wordprocessing printing cassette 30B is mounted in the cassette mounting portion. With this recognition, the CPU 42** sets the wordprocessing printing mode in the printing apparatus of the second embodiment.

Figure 11:
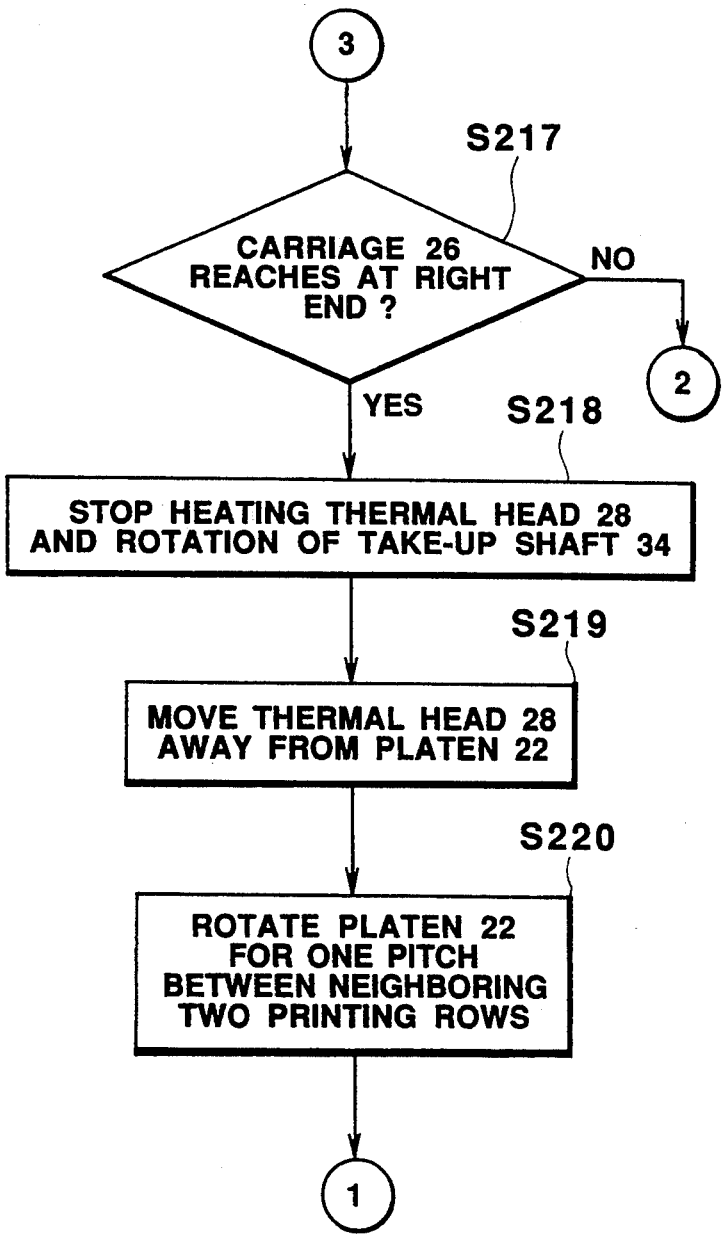
FIG. 11 is a flow chart showing a remaining part of the action of the printing apparatus in FIG. 8.

Flow charts in FIGS. 10 and 11 show an action of this embodiment.

The flow charts shown in FIGS. 10 and 11 are substantially the same as those shown in FIGS. 6 and 7 associated with the above-described first embodiment, except that contents of steps S207 and S215 of the former are slightly different from those of the corresponding steps S107 and S115 of the latter. For this reason, only the steps S207 and S215 will be described below, and a description of other steps will be omitted.

As shown in FIG. 10, in the step S207, while only an ink ribbon take-up shaft 34 is rotated, a large number of heating elements of the thermal head 28 are sequentially and selectively caused to generate heat in accordance with a printing signal. In the step S215, the carriage 26 is moved toward a right end on guide bars 24 at a predetermined speed, and at the same time the ink ribbon take-up shaft 34 is rotated at a predetermined speed. In addition, the large number of heating elements of the thermal head 28 are sequentially and selectively caused to generate heat in accordance with a printing signal.

That is, in the embodiment in which the wordprocessing printing cassette 30B and the label tape printing cassette 30A are independently prepared, the ink ribbon 38 in the wordprocessing printing cassette 30B can be drawn out from the ink ribbon supply reel hub **30*d* and taken up by the ink ribbon take-up reel hub 30*b* by only rotating the ink ribbon take-up shaft 34, and similarly, the ink ribbon 38 and the label tape 36 in the label tape printing cassette 30A also can be drawn out together from the label tape supply reel hub 30*a* by only rotating the ink ribbon take-up shaft 34 because the label tape supply shaft 32** can be freely rotated.

Figure 12:
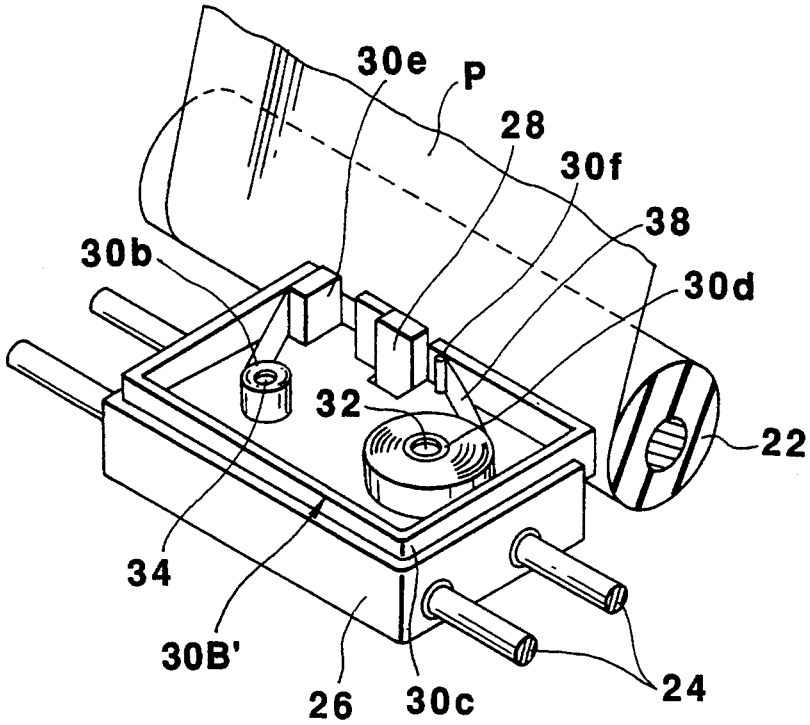
FIG. 12 is a perspective view showing another wordprocessing printing cassette used in the main part of the printing apparatus in FIG. 8.

FIG. 12 shows another wordprocessing printing cassette 30B' different from the wordprocessing printing cassette 30B in FIG. 9. The wordprocessing printing cassette 30B' in FIG. 12 is different from the wordprocessing printing cassette 30B in FIG. 9 in that an ink ribbon supply reel hub **30*d* is fitted on the freely rotatable label tape supply shaft 32, but the action of the cassette 30B' is the same as that of the cassette 30B**.

Figure 13:
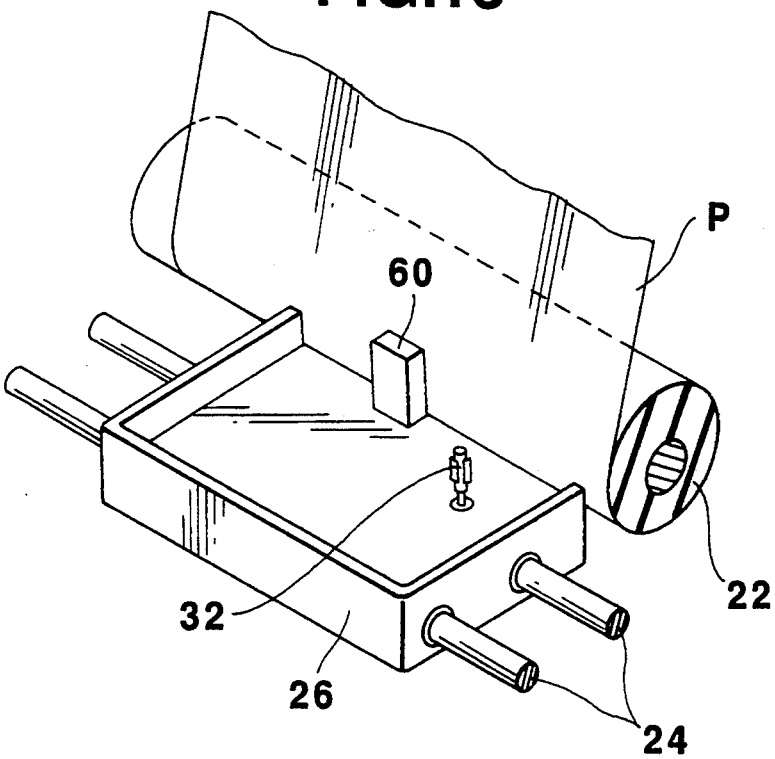
FIG. 13 is a perspective view showing a main part of a printing apparatus according to a third embodiment of the present invention, in a state that a wordprocessing printing mode is set.
Figure 14:
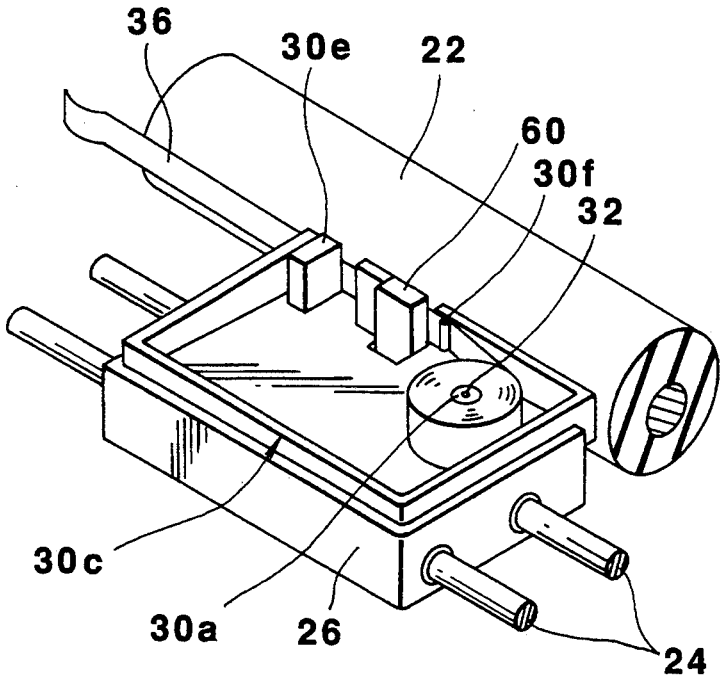
FIG. 14 is a perspective view showing a label tape printing cassette used in the main part of the printing apparatus of the third embodiment.
Figure 15:
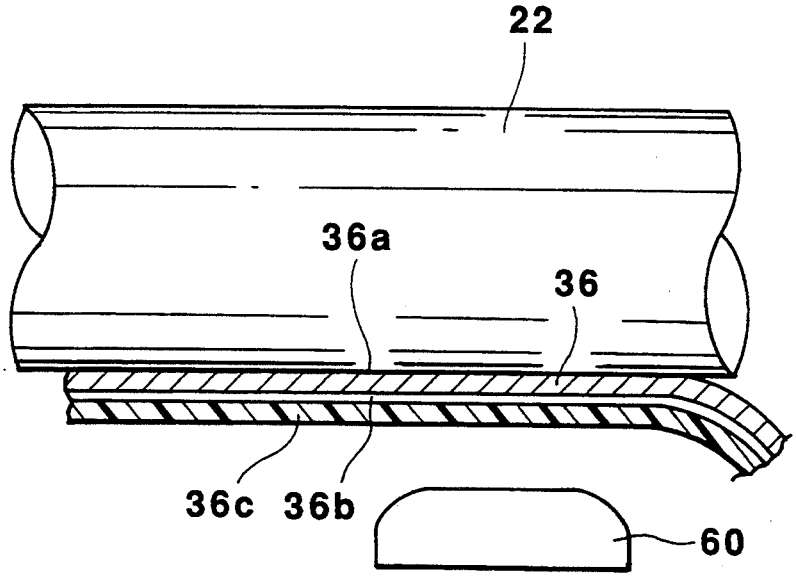
FIG. 15 is an enlarged sectional view showing a positional relationship between a label tape, drawn out from the label tape printing cassette in FIG. 14 to a position between a thermal head and a platen roller, the thermal head, and the platen roller.
Figure 16:
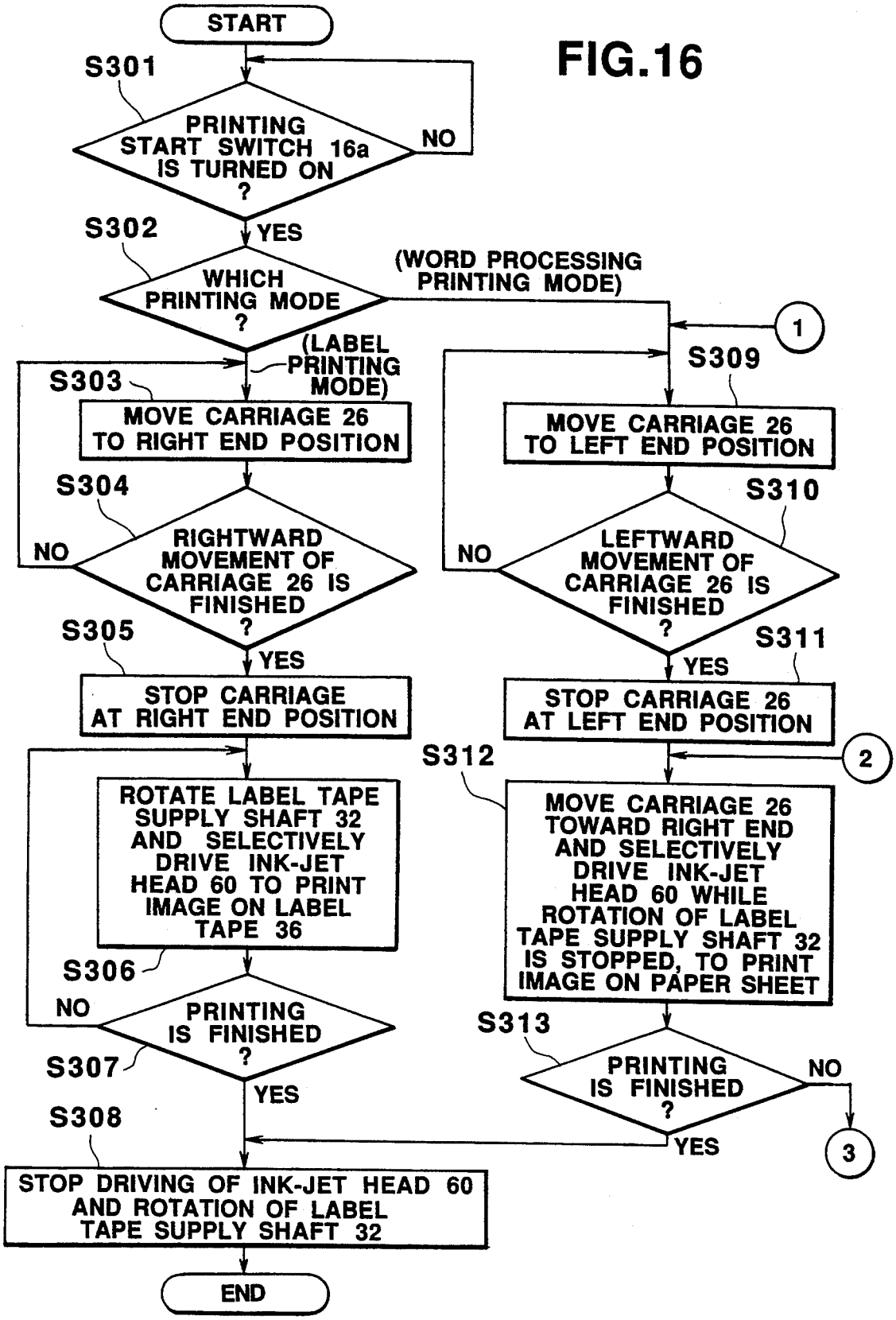
FIG. 16 is a flow chart showing a main part of an action of the printing apparatus in FIG. 13.
Figure 17:
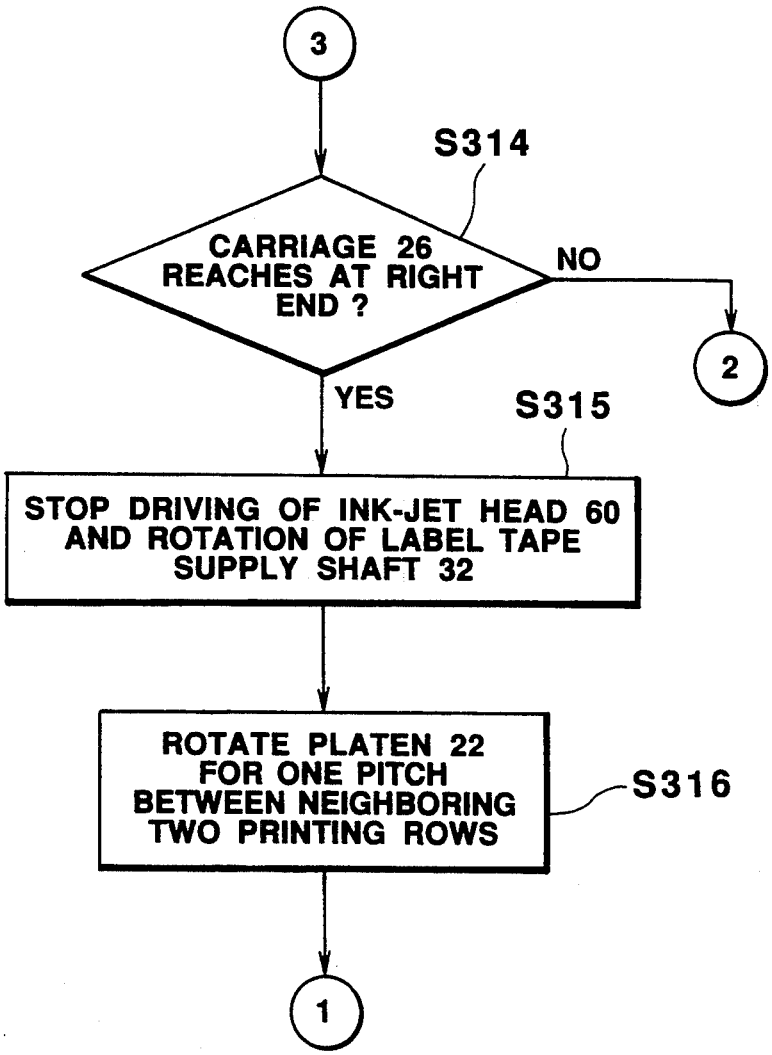
FIG. 17 is a flow chart showing the remaining part of the action of the printing apparatus in FIG. 13.

FIGS. 13 to 17 show a third embodiment of the present invention. FIGS. 13 and 14 are perspective views showing a main part of the third embodiment in states a wordprocessing printing mode and a label tape printing mode are set, respectively. FIG. 15 is an enlarged sectional view of a part of the main part shown in FIG. 13. FIGS. 16 and 17 are flow charts showing an action of the third embodiment.

A printing apparatus according to the third embodiment is a serial printing apparatus of an ink jet type or a bubble jet type. Therefore, only a label tape supply shaft 32 is projected upward in a cassette mounting portion of a carriage 26, and the ink ribbon take-up shaft 34 in the above described first and second embodiments is omitted, as shown in FIG. 13. In addition, an ink jet or bubble jet head 60 is mounted on the carriage 26 instead of the thermal head 28 in the first and second embodiments. The ink jet head 60 is fixed to the carriage 26 and is not moved toward or away from a platen roller 22. An ink tank (not shown) is coupled to the ink jet head 60. Ink in this ink tank is ejected from nozzles, selected from a large number of nozzles of the ink jet head 60, toward the platen roller 22, thereby forming, i.e., printing, an image or images on a recording paper sheet or a label tape on the platen roller 22.

In this embodiment, therefore, when an image or images is to be printed on a recording paper sheet P placed at a predetermined position on the platen roller 22, an ink ribbon cassette need not be mounted in the cassette mounting portion on the upper surface of the carriage 26, as shown in FIG. 13.

When the label tape printing mode is set, a label tape printing cassette 30C is mounted in the cassette mounting portion on the upper surface of the carriage 26, as shown in FIG. 14.

In the cassette 30C, only a label tape supply reel hub **30*a* is arranged to be freely rotatable. When the cassette 30C is mounted in the cassette mounting portion on the upper surface of the carriage 26, the label tape supply reel hub 30*a* is fitted on the label tape supply shaft 32. As shown in FIG. 15, a label tape 36 drawn out from the label tape supply reel hub 30*a* into a head insertion window extends along the platen roller 22 in its longitudinal direction such that a tape-shaped backing paper 36*a* faces the platen roller 22, and a tape-shaped label 36*c* stacked on the backing paper 36*a* through an adhesive layer 36*b* faces an ink jet surface of the ink jet head 60**.

In the third embodiment, when an image or images is to be printed on a recording paper sheet P placed on the platen roller 22 in the wordprocessing printing mode, process for the wordprocessing printing mode can be executed while the cassette 30C is mounted in the cassette mounting portion, if, in the cassette 30C shown in FIG. 14, the label tape 36 is temporarily held at a drawn out opening in the head insertion window and is removed from the ink jet surface of the ink jet head 60.

The flow charts in FIGS. 16 and 17 show the action of the third embodiment.

Steps S301 to S305 of the flow charts shown in FIGS. 16 and 17 associated with the third embodiment are the same as the steps S101 to S105 of the flow charts shown in FIGS. 6 and 7 associated with the first embodiment. Similarly, steps S307 and S308 of the former are the same as the steps S108 and S109 of the latter, and steps S309 to S311 of the former are the same as the steps S111 to S113 of the latter. In addition, steps S313 to S315 of the former are the same as the steps S116 to S118 of the latter, and step S316 of the former is the same as the step S120 of the latter. Therefore, a description of these steps will be omitted.

In the flow charts associated with the third embodiment, there are no steps corresponding to the steps S106, S110, S114, and S119 of the flow charts associated with the first embodiment, in which the thermal head 28 is moved toward or away from the platen roller 22.

In the third embodiment, if the label tape printing mode is selected in a step S302, the label tape supply shaft 32 is rotated in a step S306 to horizontally feed the label tape 36 along the platen roller 22 in its longitudinal direction with the label tape 36 being separated from the ink jet surface of the ink jet head 60 by a predetermined distance, as shown in FIG. 15. At the same time, a large number of ink Jet nozzles of the ink jet head 60 are sequentially and selectively caused to eject ink on the label tape 36 in accordance with a printing signal. As a result, an image or images based on the printing signal is printed on the label tape 36.

If the wordprocessing printing mode is selected, the carriage 26 is moved toward the right end on the guide bars 24 at a predetermined speed in a step S312 after it is once moved to the left end position on the guide bars 24. At the same time, a large number of ink jet nozzles of the ink jet head 60 are sequentially and selectively caused to eject ink in accordance with a printing signal to print an image or images based on the printing signal on the recording paper sheet P placed on the platen roller 22.

As described above, in the third embodiment, the label tape printing mode can also be performed by only mounting the cassette 30C, which holds the label tape supply reel hub **30*a* having the label tape 36 wound therearound, in the cassette mounting portion, and setting the label tape printing mode through the mode switch 16*b* of the keyboard 16 shown in FIG. 1. In addition, if the wordprocessing printing mode is set by operating the mode switch 16*b*, and the recording paper sheet P is placed at a predetermined position on the platen roller 22**, the wordprocessing printing mode can be performed.

According to any one of the printing apparatuses 10 of the first to third embodiments, in the label tape printing mode, images can only be continuously printed on the label tape 36 by a one-line length maximumly corresponding to the longitudinal length of the platen roller 22 for the following reason.

In each embodiment, in the label tape printing mode, a printed portion of the label tape 36 is horizontally discharged from the ink ribbon cassette 30 (FIG. 2), 30A (FIG. 8), or 30C (FIG. 14) to the left thereof along the platen roller 22. If, therefore, images are printed on the label tape 36 by a length exceeding the longitudinal length of the platen 22, a long printed portion of the label tape 36 hang from the cassette into the opening of the upper surface of the control means housing portion 18 of the main body 12 of the wordprocessor W in FIG. 1, and the printed portion may be twisted around members in the opening to be smeared or be damaged when it is picked up from the opening.

Embodiments of a printing tape cassette will be described in the followings with reference to FIGS. 18 to 26, the printing tape cassette being able to be used in a known printing apparatus and prevent a label tape 36 from being smeared or damaged even if images are continuously printed on the label tape 36 over one line or more.

Figure 18:
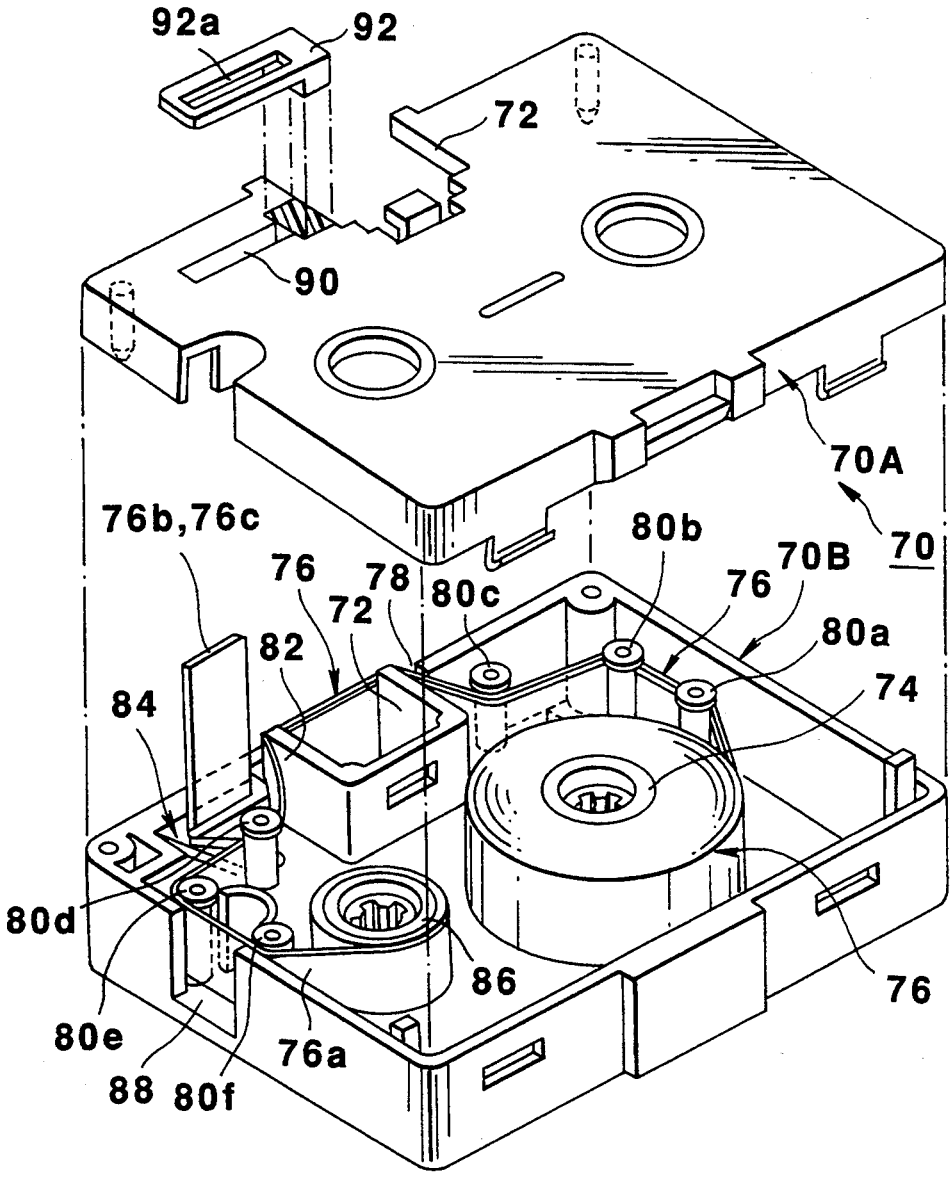
FIG. 18 is an exploded perspective view showing a first embodiment of a printing tape cassette especially suitable for a printing apparatus capable of switching a wordprocessing printing mode and a label tape printing mode, as shown in FIGS. 1 to 17.

FIG. 18 is an exploded perspective view of a printing tape cassette 70 according to a first embodiment of the present invention, which is exploded into an upper half case 70A and a lower half case 70B.

The tape cassette 70 has a substantially rectangular shape. A head insertion window 72 is formed in substantially the center of a longitudinally extending wall of the tape cassette 70. A label printing tape 76 having a three-layer structure and wound around a tape supply reel hub 74 is rotatably housed in the lower half case 70B at a right side of the head insertion window 72.

Figure 19:
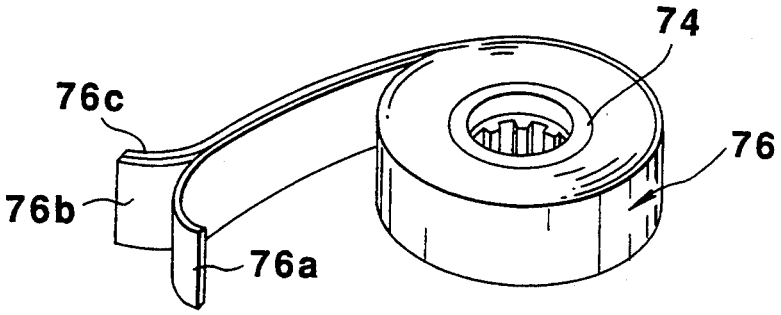
FIG. 19 is a perspective view showing a construction of a label printing tape wound around a label printing tape supply reel hub in the printing tape cassette in FIG. 18.

As shown in FIG. 19, the label printing tape 76 is constituted by a thermal transfer ink ribbon **76*a*, a tape-shaped label 76*b* formed of a synthetic resin and stacked on the ink ribbon 76*a*, and a tape-shaped backing paper 76*c* stacked on the label 76*b*** through an adhesive layer.

Figure 20:
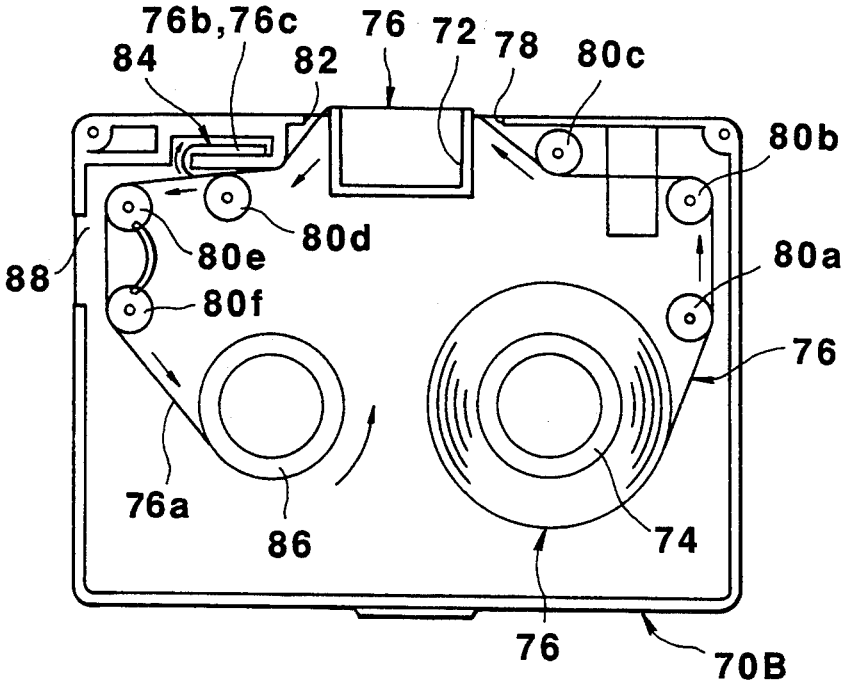
FIG. 20 is a plan view showing an internal construciton of a lower half case of the printing tape cassette in FIG. 18.

As shown in FIGS. 18 and 20, the label printing tape 76 is guided from the tape supply reel hub 74 to a tape drawn out opening 78 on a right end of the head insertion window 72 by a plurality of guide pins **80*a*, 80*b*, and 80*c* arranged on a bottom surface of the lower half case 70B. After crossing the head insertion window 72, the label printing tape 76 is guided into the tape cassette 70 again through a tape introducing opening 82 at a left end of the head insertion window 72, and is separated into the ink ribbon 76*a* and the label 76*b* with the backing paper 76*c* by a label direction changing means 84 arranged on a left side of the head insertion window 72**.

Subsequently, the ink ribbon **76*a* is guided to an ink ribbon take-up reel hub 86, arranged on the left side of the head insertion window 72 on the bottom surface of the lower half case 70B to be symmetrical with the tape supply reel hub 74, by a plurality of guide pins 80*d*, 80*e*, and 80*f* arranged on the bottom surface of the lower half case 70B. While the ink ribbon 76*a* is guided in this manner, it crosses an ink ribbon driving roller insertion window 88 formed in a left side wall of the tape cassette 70. As shown in FIG. 18, the label direction changing means 84, which separates the label 76*b* and the backing paper 76*c* from the ink ribbon 76*a*, changes an extending direction of the label 76*b* and the backing paper 76*c* to an upward direction to discharge them upward from a label discharge opening 90 formed in the upper half case 70A on the left side of the head insertion window 72**.

A label cutting guide member 92 serving as a label cutting position indicating member is formed near the label discharge opening 90 in the upper half case 70A. The label cutting guide member 92 is located at a position being away from the label discharge opening 90 by a predetermined height, extends over the label discharge opening 90, and has an opening **92*a* corresponding to the label discharge opening 90. The label 76*b* and the backing paper 76*c*, which are discharged upward from the label discharge opening 90, further extend upward from the guide member 92 through the opening 92*a***.

Figure 21:
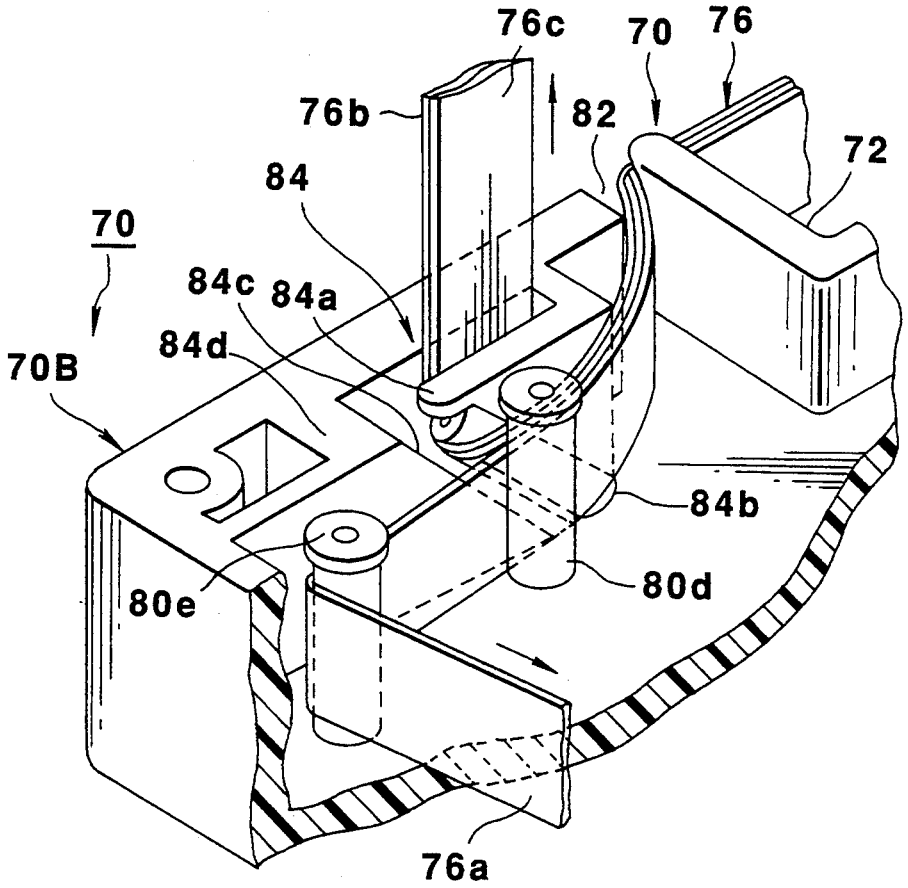
FIG. 21 is an enlarged perspective view showing a label direction changing means as a main part of the printing tape cassette in FIG. 18.

As shown in FIG. 21, the label direction changing means 84 has a label direction changing guide wall **84*a* projecting inward from an inner surface of the longitudinally extending wall of the lower half case 70B at a position near the tape introducing opening 82, and then bend to extend along the inner surface in a direction to be far away from the tape introducing opening 82. An extending end surface of the label direction changing guide wall 84*a* is inclined in a direction to be far away from the tape introducing opening 82 as it moves upward from the bottom surface of the lower half case 70B. A guide roller 84*b*** is rotatably supported on this inclined extending end surface.

The label direction changing means 84 further has a guide projection **84*d* projecting inward from the inner surface of the longitudinally extending wall of the lower half case 70B at a position remoter from the tape introducing opening 82 than the extending end surface of the label direction changing guide wall 84*a*, and having an inclined surface 84*c*** being in parallel to and facing the extending end surface.

The guide pin **80*d* is arranged near the guide roller 84*b* of the label direction changing guide wall 84*a* and the inclined surface 84*c* of the guide projection 84*d*. When viewed from the horizontal direction, it looks like as if the guide pin 80*d* crosses the guide roller 84*b* and the inclined surface 84*c***.

The label printing tape 76 introduced into the tape cassette 70 through the tape introducing opening 82 is guided to a space between the guide pin **80*d* and the label direction changing guide wall 84*a*. In this space, the label 76*b* and the backing paper 76*c* which are adhered to each other through the adhesive layer are separated from the ink ribbon 76*a* by the inclined surface 84*c* of the guide projection 84*d*. The direction of the label 76*b* and the backing paper 76*c* is then changed to an upward direction by the guide roller 84*b* of the label direction changing guide wall 84*a*, and the label 76*b* and the backing paper 76*c* are moved between the inclined surface 84*c* and the inner surface of the longitudinally extending wall of the lower half case 70B toward the label discharge opening 90 (FIG. 18>of the upper half case 70A**.

Note that the guide roller **84*b* can be omitted if the extending end surface of the label direction changing guide wall 84*a*** is finished to be very smooth so as to have a low friction.

In addition, the guide pin **80*d* near the guide roller 84*b* and the inclined surface 84*c* of the guide projection 84*d* may be designed to be movable while it is kept perpendicular to the bottom surface of the lower half case 70B, and be urged toward the guide roller 84*b* by urging means. In this case, the ink ribbon 76*a***, the label 76*b*, and the backing paper 76*c* are clamped between the guide roller 84*b* and the guide pin 80*d*.

Figure 22:
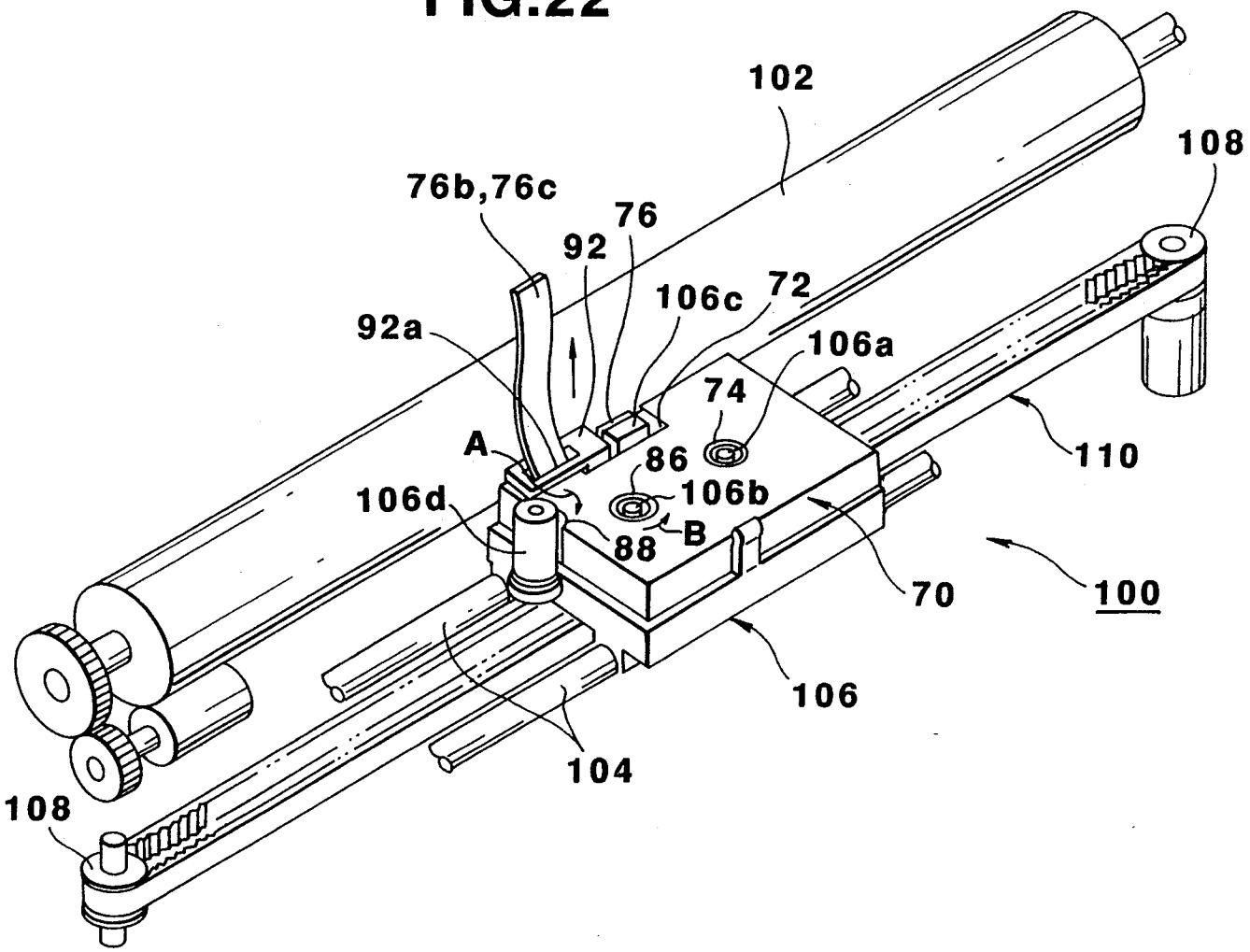
FIG. 22 is a perspective view showing a state in which the printing tape cassette of the first embodiment in FIG. 18 is mounted in a predetermined cassette mounting portion of a carriage of a general serial printing apparatus of a thermal transfer type.

FIG. 22 shows a state in which the above-described tape cassette is incorporated in a serial printing apparatus 100.

This printing apparatus 100 is used in a wordprocessor. The tape cassette 70 is detachably mounted in a cassette mounting portion on an upper surface of a carriage 106 slidably arranged on a pair of guide rods 104 extending in a longitudinal direction of a platen roller 102 to be parallel thereto.

A tape supply reel shaft 106*a* and an ink ribbon take-up reel shaft 106*b* projecting upward from the cassette mounting portion of the carriage 106 are respectively inserted in the tape supply reel hub 74 and the ink ribbon take-up reel hub 86 of the tape cassette 70. A thermal head 106*c* of the cassette mounting portion is inserted in the head insertion window 72 of the tape cassette 70. An ink ribbon driving roller 106*d* of the carriage 106 is laterally inserted in the ink ribbon driving roller insertion window 88 of the tape cassette 70.

The carriage 106 can be reciprocated in the longitudinal direction of the platen roller 102 at a predetermined speed by driving means (not shown) through a carriage driving belt 110 wound around a pair of pulleys 108, located under both ends of each of the pair of guide rods 104.

The printing apparatus 100 having such an arrangement is known.

Assume that in the wordprocessor incorporating the printing apparatus 100, a label tape printing mode is selected through a wordprocessing printing mode/label tape printing mode change switch, and that the printing tape cassette 70 for label printing is mounted in the cassette mounting portion of the carriage 106, as shown in FIG. 22. Under this condition, when a printing start switch of the wordprocessor is turned on, the carriage 106 is moved to a predetermined home position (normally, the left end of the paired guide rods 104) and is stopped at the home position.

At the home position, the ink ribbon driving roller 106*d* is rotated in a clockwise direction indicated by an arrow A, and the ink ribbon take-up reel shaft 106*b* is rotated in a counterclockwise direction indicated by an arrow B. At this time, the tape supply reel shaft 106*a* is freely rotatable. As shown in FIG. 20, when the ink ribbon 76*a* is pulled by the ink ribbon driving roller 106*d* and is taken up by the ink ribbon take-up reel hub 86 on the ink ribbon take-up reel shaft 106*b*, the label printing tape 76 on the tape supply reel hub 74 is drawn out from the tape supply reel hub 74, crosses the head insertion window 72, and reaches the label direction changing means 84.

Meanwhile, the thermal head 106*c* selectively contacts and separates from the ink ribbon 76*a* of the label printing tape 76, which crosses the head insertion window 72, on the basis of the printing signal, and thermally transfers an image or images based on a printing signal from the ink ribbon 76*a* to the label 76*b*.

After the label 76*b* and the backing paper 76*c* are separated from the ink ribbon 76*a* by the label direction changing means 84, the moving direction of the label 76*b* and the backing paper 76*c* is changed to an upward direction so that the label 76*b* and the backing paper 76*c* are discharged upward through the label discharge opening 90 of the upper half case 70A and the opening 92*a* of the label cutting guide member 92.

After printing of an image or images based on all printing signals is completed, a cutting tool such as a knife or scissors is inserted in a gap between the upper surface of the upper half case 70A and the label cutting guide member 92 to cut a printed portion of the label 76*b* with the backing paper 76*c* from their remaining portion. The cut out printed label 76*b*, together with the adhesive layer, can be manually separated from the backing paper 76*c* and can be adhered on a desired place with the adhesive layer.

In the printing apparatus 100, although a relatively large resistance to stretching is produced in the ink ribbon 76*a* at the label direction changing means 84, the label printing tape 76 can be smoothly drawn out from the tape supply reel hub 74 at a predetermined speed against the resistance owing to the ink ribbon driving roller 106*d*.

By using the tape cassette 70 designed to discharge the printed label 76*b* upward, the following trouble can be effectively prevented. That is, the printed label 76*b* hangs from the carriage 106 and is twisted around members in the carriage 106 to be smeared, or is damaged when it is picked up. Therefore, images can be continuously printed on the label 76*b* over a length exceeding the length of the platen roller 102 (i.e., a normal maximum one-line length).

When an image or images is to be printed on a recording paper sheet placed on the platen roller 102 in the above-described printing apparatus 100 in the same manner as in a general printing apparatus of a wordprocessor, a general ink ribbon cassette, which rotatably holds a pair of reel hubs around which a thermal ink ribbon is wound, is mounted in the cassette mounting portion on the carriage 106. The wordprocessing printing mode is then selected in the wordprocessor, and the printing start switch is turned on.

The carriage 106 is once moved to the left end of the paired guide rods 104, and is moved toward a right end thereof at a predetermined speed. Meanwhile, the ink ribbon driving roller 106*d* is rotated clockwise and the ink ribbon take-up reel shaft 106*b* is rotated counterclockwise to draw out the ink ribbon from a reel hub on the tape supply reel shaft 106*a* and to cross the thermal head 106*c*. Thereafter, the ink ribbon is taken up by a reel hub on the ink ribbon take-up reel shaft 106*b*.

The thermal head 106*c* lightly pushes the thermal transfer ink ribbon on the recording paper sheet on the platen roller 102 in accordance with a printing signal from a control means, and thermally transfers an image or images, based on the printing signal, from the ink ribbon to the recording paper sheet. If printing of images based on all printing signals is not finished even after printing of images corresponding to a predetermined one-line length in the longitudinal direction of the platen roller 102 is completed, the carriage 106 is quickly returned to the left end of the guide rods 104 after the thermal head 106*c* is separated from the ink ribbon and the taking-up operation of the ink ribbon is stopped, thus printing of the remaining images starts in the above-described manner.

Note that while the carriage 106 returns to the left end position, the platen roller 102 is rotated by an amount corresponding to a predetermined one-line space to move the recording paper sheet in the circumferential direction by a distance corresponding to one line space.

Figure 23:
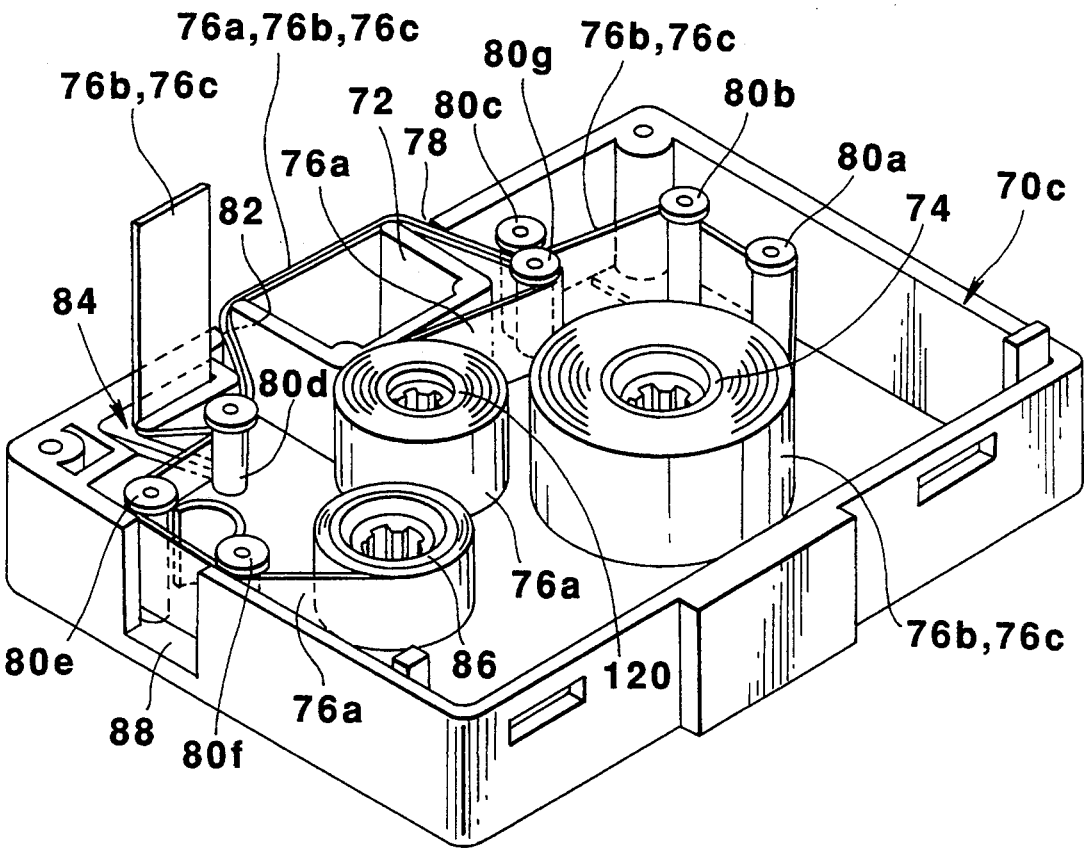
FIG. 23 is a perspective view showing only a lower half case of a printing tape cassette of a second embodiment designed for the same purpose as that of the printing tape cassette of the first embodiment in FIG. 18.
Figure 24:
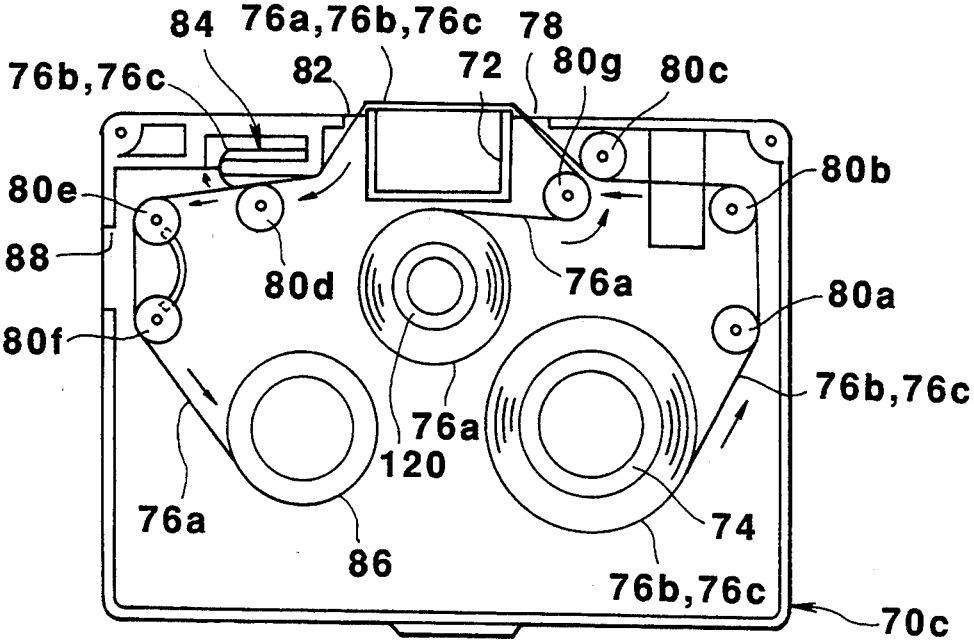
FIG. 24 is a plan view showing an internal construciton of the lower half case of the printing tape cassette in FIG. 23.

FIGS. 23 and 24 show a lower half case 70C of a second embodiment of the tape cassette 70. Since the upper half case of the second embodiment is the same as the upper half case 70A of the first embodiment, a description thereof will be omitted. The same reference numerals in the lower half case 70B of the first embodiment are used in FIGS. 23 and 24 to denote the same parts as in the lower half case 70B of the first embodiment, and a detailed description thereof will be omitted.

In this embodiment, only a tape-shaped label **76*b* and a tape-shaped backing paper 76*c* stuck on the label 76*b* through its adhesive layer are wound around a tape supply reel hub 74 at a right side of a head insertion window 72**.

An ink ribbon **76*a* is wound around an ink ribbon supply reel hub 120 rotatably held on a bottom surface of the lower half case 70C, between the tape supply reel hub 74 and an ink ribbon take-up reel hub 86, at a position closer to the head insertion window 72 than the hubs 74 and 86**.

The ink ribbon **76*a* drawn out from the ink ribbon supply reel hub 120 is guided by a guide pin 80*g* additionally formed adjacent to a guide pin 80*c* formed in front of a tape drawn out opening 78 of the lower half case 70C to guide the label 76*b* and the backing paper 76*c*, and is overlapped on the label 76*b* and the backing paper 76*c* between the guide pin 80*c* and the guide pin 80*g***.

The ink ribbon **76*a*, the label 76*b*, and the backing paper 76*c* drawn out from the tape drawn out opening 78 in a stacked state cross the head insertion window 72 with the ink ribbon 76*a* being opposed to the head insertion window 72, the backing paper 76*c* being located at a outermost position with respect to the head insertion window 72, and the label 76*b* being sandwiched between the ink ribbon 76*a* and the backing paper 76*c***.

The ink ribbon **76*a*, the label 76*b*, and the backing paper 76*c* which are introduced into the lower half case 70C again through a tape introducing opening 82 are separated into the ink ribbon 76*a* and the label 76*b* with the backing paper 76*c* by a label direction changing means 84. Thereafter, the ink ribbon 76*a* is guided by guide pins 80*d*, 80*e*, and 80*f* and is taken up by the ink ribbon take-up reel hub 86. The moving direction of the label 76*b* with the backing paper 76*c* is changed to an upward direction by the label direction changing means 84, and the label 76*b* with the backing paper 76C are finally discharged upward through the label discharge opening 90 of the upper half case 70A (FIG. 18) and the opening 92*a* of the label cutting guide member 92**.

In this embodiment, similar to the previous embodiment, the ink ribbon **76*a*, the label 76*b*, and the backing paper 76*c* are traveled by the ink ribbon driving roller 106*d* of the carriage 106 (FIG. 22), which is inserted in an ink ribbon driving roller insertion window 88 in a left side wall of the lower half case 70C. More specifically, in the carriage 106, only the ink ribbon driving roller 106*d* and the ink ribbon take-up reel shaft 106*b* are respectively rotated in the clockwise direction indicated by an arrow A and the counterclockwise direction indicated by an arrow B, similar to the case wherein the label printing tape 76 of the tape cassette 70 of the first embodiment is driven. The tape supply reel shaft 106*a*** is freely rotated.

In this embodiment, the ink ribbon **76*a*, and the label 76*b* with the backing paper 76*c* are not wound around the tape supply reel hub 74 in a stacked state. Even if the tape cassette 70 is stored in a high-temperature place for a long period of time, the ink ribbon 76*a* and the label 76*b* with the backing paper 76*c* do not stick to each other by a pressure produced when they are wound around the tape supply reel hub 74, thereby eliminating the possibility that they cannot be easily separated from each other by the label direction changing means 84**.

Figure 25:
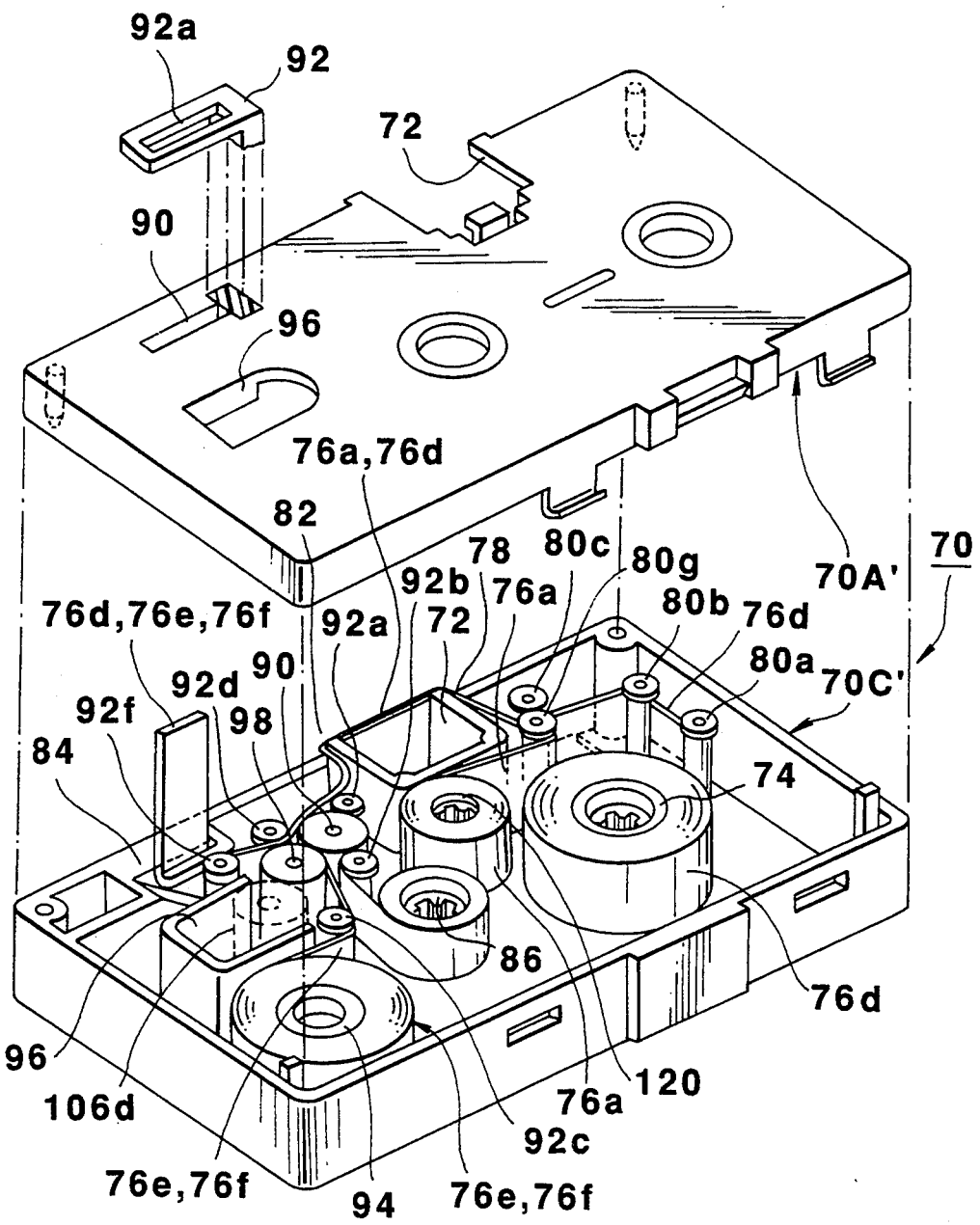
FIG. 25 is an exploded perspective view showing a printing tape cassette of a third embodiment designed for the same purpose as that of the printing tape cassette of the first embodiment in FIG. 18.
Figure 26:
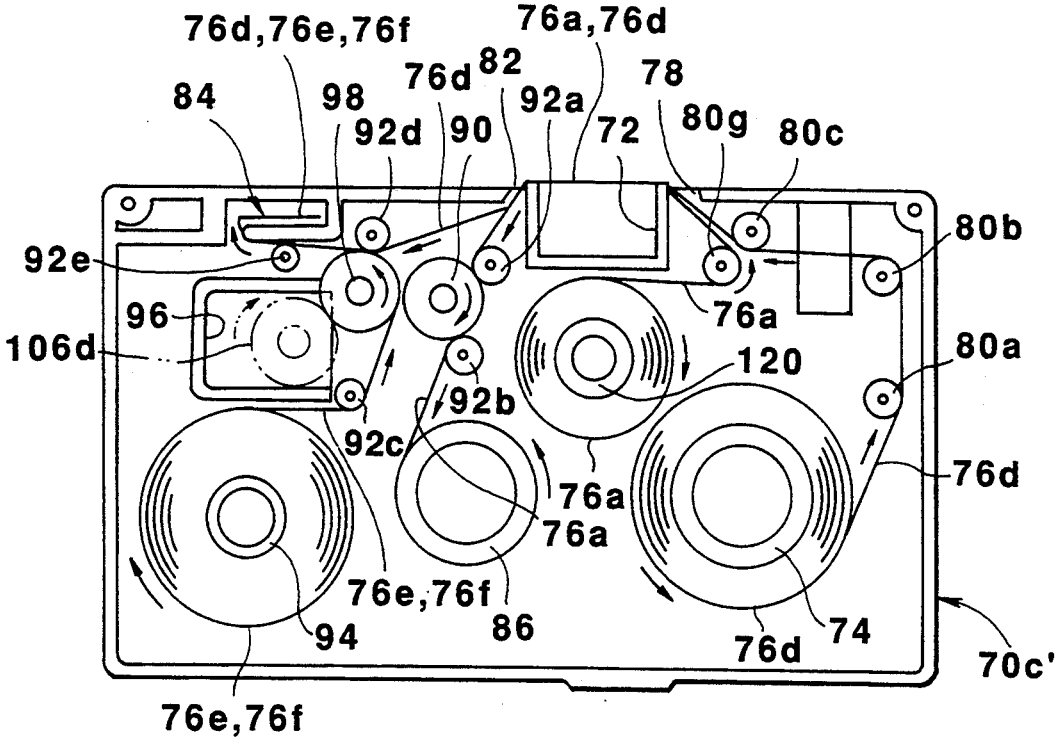
FIG. 26 is a plan view showing an internal construction of a lower half case of the printing tape cassette in FIG. 25.

A third embodiment of the tape cassette 70 will be described in the followings with reference to FIGS. 25 and 26. An upper half case 70A' and a lower half case 70C' of the tape cassette 70 of a third embodiment are formed by extending left ends of the upper half case 70A of the first embodiment and the lower half case 70C of the second embodiment to the left.

Note that right side portions of the upper half case 70A of the first embodiment and the lower half case 70C of the second embodiment, which are located on a right side of the ink ribbon take-up reel hub 86, have 20 the same structures as those of the upper and lower half cases 70A' and 70C' of the third embodiment. Therefore, the reference numerals used in the first and second embodiments denote the same parts in the third embodiment, and a detailed description thereof will be omitted.

In this embodiment, only a tape-shaped label **76*d* having no adhesive layer is wound around a tape supply reel hub 74 on a right side of a head insertion window 72. The tape-shaped label 76*d*** is formed of a transparent synthetic resin.

The label **76*d* drawn out from the tape supply reel hub 74 is guided to a tape drawn out opening 78 of the lower half case 70C' by a plurality of guide pins 80*a*, 80*b*, and 80*c*. An ink ribbon 76*a* drawn out from an ink ribbon supply reel hub 120 is guided into a space between a guide pin 80*g* and a guide pin 80*c* in front of the tape drawn out opening 78, and is stacked on the label 76*d*. The ink ribbon 76*a*, together with the label 76*d*, is drawn out from the tape drawn out opening 78 into the head insertion window 72, and then crosses the head insertion window 72**.

At this time, an image or images based on a printing signal is transferred from the ink ribbon **76*a* onto the label 76*d* by a thermal head (not shown) in the head insertion window 72** in a laterally inverted state (a so-called mirror character or image).

The ink ribbon **76*a* and the label 76*d* which are introduced into the lower half case 70C' again through a tape introducing opening 82 are separated from each other immediately after they pass through the tape introducing opening 82**.

The ink ribbon **76*a* advances toward an ink ribbon take-up reel hub 86, located behind the head insertion window 72 on its left side, immediately after the ribbon 76*a* passes through the tape introducing opening hole 82. Meanwhile, the ink ribbon 76*a* is urged against an ink ribbon driving roller 90, disposed on a bottom surface of the lower half case 70C', by a pair of guide pins 92*a* and 92*b***.

In the embodiment, a backing paper supply reel hub 94 is freely rotatably disposed on a left side of the ink ribbon take-up reel hub 86 in the leftwardly, extended portion of the lower half case 70C'. A tape-shaped backing paper **76*e* and a double coated adhesive tape 76*f* stacked on the backing paper 76*e* are wound around the backing paper supply reel hub 94**.

A backing paper/ink ribbon driving roller insertion window 96 is formed in the leftwardly extended portion at a position between the backing paper supply reel hub 94 and a front wall of the lower half case 70C'. A label direction changing means 84 is arranged on the front wall of the leftwardly extended portion of the lower half case 70C'.

A label/backing paper driving roller 98 is disposed on one end of the backing paper/ink ribbon driving roller insertion window 96, located on the label direction changing means 84 side. The label/backing paper driving roller 98 is coupled to the ink ribbon driving roller 90 to be rotated in a direction opposite to a rotating direction of the ink ribbon driving roller 90.

The backing paper **76*e* with the double coated adhesive tape 76*f*, which is drawn out from the backing paper supply reel hub 94, is guided to the label/backing paper driving roller 98 by a guide pin 92*c*, and the label 76*d* separated from the ink ribbon 76*a* at the tape introducing opening 82 is also guided to the label/backing paper driving roller 98**.

The backing paper **76*e* with the double coated adhesive tape 76*f* and the printed label 76*d* are pressed against each other on the label/backing paper driving roller 98 by a guide pin 92*d*. As a result, an unused adhesive surface of the double coated adhesive tape 76*f* is adhered to a printed surface of the printed label 76*d***.

The printed label **76*d* and the backing paper 76*e* with the double coated adhesive tape 76*f*, which are adhered and stacked on each other, are guided to the label direction changing means 84 by a guide pin 92*e* between the driving roller insertion window 96 and the label direction changing means 84. The moving direction of the label 76*d* and the backing paper 76*e* is changed to an upward direction by the label direction changing means 84. Finally, they are discharged upward through a label discharge opening 90, formed in the leftwardly extended portion of the upper half case 70A' in correspondence with the label direction changing means 84, and an opening 92*a* in a label cutting guide member 92**.

In this embodiment, the above described movement of the label **76*d*, the ink ribbon 76*a*, and the backing paper 76*e* with the double coated adhesive tape 76*f* are performed when the tape cassette 70 of the embodiment is mounted in a cassette mounting portion formed by leftwardly extending the left end of the cassette mounting portion of the carriage 106 of the printing apparatus 100, shown in FIG. 22. At this time, the label supply reel hub 74, the ink ribbon supply reel hub 120, and the backing paper supply reel hub 94 can be freely rotatable. As shown in FIG. 26, the label/backing paper driving roller 98 is rotated counterclockwise by an ink ribbon driving roller 106*d* of the carriage 106, inserted in the backing paper/ink ribbon driving roller insertion window 96 and pressed against the roller 98. Meanwhile, a reverse rotational force is transmitted from the label/backing paper driving roller 98 to the ink ribbon driving roller 90, and the roller 90 is rotated clockwise. The ink ribbon take-up reel hub 86 is rotated counterclockwise by the ink ribbon take-up reel shaft 106*b* of the carriage 106**.

According to the tape cassette of the third embodiment, the printed surface of the label **76*d* is covered by the double coated adhesive tape 76*f*. Therefore, after the printed label 76*d*, together with the backing paper 76*e* with the double coated adhesive tape 76*f*, is cut from a remaining portion of the label 76*d* at the label cutting guide member 92 of the upper half case 70A', the backing paper 76*e* is removed from the printed label 76*d* with the double coated adhesive tape 76*f* being adhered to the printed label 76*d* and the label 76*d* is stuck on a desired object through the double coated adhesive tape 76*f*, the printed surface of the label 76*d* is covered with the double coated adhesive tape 76*f*** and hence is not exposed to the open air. Therefore, the printed surface can be protected over a long period of time, and erasure of an image or images from the printed surface due to rubbing can be prevented.

Furthermore, in this embodiment, since the printed label **76*d*, which is discharged upward from the tape cassette 70 together with the backing paper 76*e* with the double coated adhesive tape 76*f*, faces the front side of the carriage 106 or faces in a direction being far away from the platen roller 102, a mirror character or image on the printed surface can be seen through the double coated adhesive tape 76*f* as a normal character or image from the front side of the carriage 106**.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A printing apparatus comprising:

an apparatus main body in which a sheet-like printing medium or a tape-like printing medium contained in a cassette can be mounted;

printing means capable of printing an image either on the sheet-like printing medium or the tape-like printing medium contained in said cassette; and control means for, when an image is printed on the sheet-like printing medium, controlling said printing means and the sheet-like printing medium to make them move relative to each other and cause said printing means to print the image on the sheet-like printing medium, and for, when an image is printed on the tape-like printing medium, controlling said printing means and the tape-like printing medium to make them move relative to each other and cause said printing means to print the image on the tape-like printing medium.

2. An apparatus according to claim 1, wherein said control means includes:

mode setting means capable of selectively setting first and second printing modes;

first control means for, when the first printing mode is set by said mode setting means, controlling said printing means to perform printing an image on the sheet-like printing medium; and second control means for, when the second printing mode is set by said mode setting means, controlling said printing means to perform printing an image on the tape-like printing medium.

3. An apparatus according to claim 2, wherein said mode setting means comprises an operating member for allowing mode setting by a manual operation.

4. An apparatus according to claim 2, wherein said mode setting means comprises means for automatically setting the second printing mode when said cassette is mounted in said apparatus main body.

5. An apparatus according to claim 1, wherein said printing means is movable relative to said apparatus main body, and said control means allows the relative movement in forward and reverse directions, for each printing operation, when an image is printed on the sheet-like printing medium, and allows the relative movement in only one direction, for each printing operation, when an image is printed on the tape-like printing medium.

6. An apparatus according to claim 1, wherein
said cassette further contains an ink ribbon, and
said printing means comprises a printing head for printing an image on the printing medium through said ink ribbon.

7. An apparatus according to claim 1, wherein said printing means comprises a printing head for printing an image on the printing medium by ejecting liquid ink thereon.

8. A printing tape cassette comprising:
a cassette main body having upper and lower surfaces, for containing a tape-like printing medium on which an image is printed by printing means in the main body, both an upper and a lower edge portion of the printing medium being located along the upper and lower surfaces of the main body; and
bending means including guide means for upwardly bending a printed portion of the printing medium discharged out from the upper surface of the main body after an image is printed thereon by said printing means.

9. A cassette according to claim 8, further comprising indicating means, arranged near said bending means, for indicating a position at which the printed portion of the printing medium is to be cut out from a remaining portion of the printing medium contained in the main body.

10. A printing tape cassette detachably mounted in a carriage of a printing apparatus for printing an image on a sheet-like printing medium placed thereon while moving the carriage having printing means along sheet-like printing medium in a predetermined direction,
wherein said cassette contains a tape-like printing medium, on which an image is printed by the printing means, instead of the sheet-like printing medium.

11. A cassette according to claim 10, wherein
said cassette further contains an ink ribbon, and
the printing means comprises a printing head for printing an image on the printing medium through the ink ribbon.

12. A cassette according to claim 11, wherein
the ink ribbon comprises a heat sensitive ink ribbon formed by impregnating a base member with a hot-melt or hot-sublimation ink, and
the printing head comprises a thermal head having a large number of heating elements.

13. A cassette according to claim 10, further comprising bending means for bending the printed portion of the printing medium after an image is printed thereon by the printing means.

14. A cassette according to claim 13, wherein said bending means comprises by guide means for bending the printed portion of the printing medium toward the upper surface of said cassette main body.

15. A cassette according to claim 13, further comprising indicating means, arranged near said bending means, for indicating a position at which the printed portion of the printing medium is cut.

16. A cassette according to claim 10, wherein the printing means comprises a printing head for printing an image on the printing medium by ejecting liquid ink thereon.

* * * * *